US010849420B2

(12) United States Patent
Haemerle

(10) Patent No.: US 10,849,420 B2
(45) Date of Patent: Dec. 1, 2020

(54) PAINT TRANSFER SYSTEM

(71) Applicant: Richard R. Haemerle, Valley Park, MO (US)

(72) Inventor: Richard R. Haemerle, Valley Park, MO (US)

( * ) Notice: Subject to any disclaimer, the term of this patent is extended or adjusted under 35 U.S.C. 154(b) by 0 days.

(21) Appl. No.: 16/028,000

(22) Filed: Jul. 5, 2018

(65) Prior Publication Data

US 2018/0317642 A1 Nov. 8, 2018

Related U.S. Application Data

(62) Division of application No. 14/988,966, filed on Jan. 6, 2016, now Pat. No. 10,039,369.

(51) Int. Cl.

| | |
|---|---|
| ***A46B 11/06*** | (2006.01) |
| ***A46B 15/00*** | (2006.01) |
| ***B05C 17/015*** | (2006.01) |
| ***B05C 17/005*** | (2006.01) |
| ***B65D 33/16*** | (2006.01) |
| ***B65D 33/00*** | (2006.01) |
| ***B44D 3/14*** | (2006.01) |

(52) U.S. Cl.

CPC ..... *A46B 11/06* (2013.01); *B05C 17/015* (2013.01); *B65D 33/16* (2013.01); *A46B 15/00* (2013.01); *B05C 17/005* (2013.01); *B44D 3/14* (2013.01); *B65D 33/00* (2013.01)

(58) Field of Classification Search

CPC ..... B65D 33/004; B65D 33/16; B65D 33/00; B05C 17/015; B05C 17/00583; B05C 17/005; A46B 11/06; A46B 15/095; A46B 2200/202; A46B 15/00; B44D 3/14

See application file for complete search history.

(56) References Cited

U.S. PATENT DOCUMENTS

| | | | | |
|---|---|---|---|---|
| 1,221,170 A * | 4/1917 | Gasparaitis | ..... | B05C 17/002 401/188 R |
| 2,711,748 A | 6/1955 | Barsness | | |
| 3,112,505 A | 12/1963 | Hirst | | |

(Continued)

OTHER PUBLICATIONS

Paint Spraying and Pressure Rolling Equipment brochure, 2009.

(Continued)

*Primary Examiner* — David J Walczak

(74) *Attorney, Agent, or Firm* — Husch Blackwell LLP

(57) ABSTRACT

A paint transfer system for both automatically and manually transferring paint from a paint container directly to a paint brush including a paint container member, a pump mechanism, and a paint brush apparatus coupled together in fluid communication wherein the paint brush apparatus includes a paint brush having a bladder member or housing member positioned and located within the paint brush adjacent to or within its bristle members as well as an optional valve control member for controlling and distributing the flow of paint to the bristle members. In some embodiments, a remote controller is positioned between the paint brush apparatus and the paint container member for allowing a user to selectively activate the flow of paint from the paint container to the paint brush apparatus. A variety of different pumping mechanisms are utilized for transferring paint from the paint container member to the paint brush apparatus.

6 Claims, 20 Drawing Sheets

(56) References Cited

U.S. PATENT DOCUMENTS

| | | | | | |
|---|---|---|---|---|---|
| 3,170,182 | A | | 2/1965 | Burian | |
| 3,284,838 | A | * | 11/1966 | Bieganowski | A46B 11/063 401/194 |
| 3,608,120 | A | | 9/1971 | Seiler | |
| 3,676,010 | A | * | 7/1972 | Kirch | A46B 11/063 401/188 R |
| 3,690,779 | A | * | 9/1972 | Ellis | A46B 11/063 401/266 |
| 4,263,055 | A | | 4/1981 | Permar | |
| 4,597,687 | A | | 7/1986 | O'Brien et al. | |
| 4,639,156 | A | | 1/1987 | Stern et al. | |
| 4,790,679 | A | | 12/1988 | Murphy | |
| 4,928,402 | A | | 5/1990 | Allen | |
| 5,054,947 | A | | 10/1991 | Frank et al. | |
| 5,174,445 | A | | 12/1992 | Mull | |
| 5,381,964 | A | | 1/1995 | Reyna | |
| 5,755,361 | A | | 5/1998 | Restive | |
| 5,904,434 | A | | 5/1999 | Bekius et al. | |
| 5,931,595 | A | | 8/1999 | Van Oost | |
| D425,678 | S | | 5/2000 | Hull | |
| 6,244,273 | B1 | | 6/2001 | Higgins | |
| 6,666,925 | B2 | | 12/2003 | Brackett | |
| 7,266,858 | B2 | | 9/2007 | Cronin | |
| 2005/0039785 | A1 | | 2/2005 | Knowles | |
| 2007/0089765 | A1 | | 4/2007 | Clark | |
| 2008/0028556 | A1 | | 2/2008 | Papenfuss | |
| 2008/0264110 | A1 | | 10/2008 | Sinykin | |
| 2008/0265468 | A1 | | 10/2008 | Sinykin | |
| 2008/0269033 | A1 | | 10/2008 | Sinykin | |

OTHER PUBLICATIONS

Video found at http://diplessbrush.com/wp-content/uploads/2015/07/Dipless-2015-IMG_0899.mov?id=0, 2015.

* cited by examiner

PAINT TRANSFER SYSTEM

CROSS-REFERENCE TO RELATED APPLICATIONS

This application is a divisional application and claims the benefit of and priority to U.S. patent application Ser. No. 14/988,966 filed Jan. 6, 2016, which application is hereby incorporated herein by reference in its entirety.

BACKGROUND OF INVENTION

The present invention relates generally to a paint transfer system and, more particularly, to several embodiments of both an automatic and a manual paint pumping system for transferring paint from a paint holding container directly to the bristle members of a paint brush.

Professional painters and do-it-yourselfers alike often undertake painting projects to decorate interior and exterior surfaces of commercial and residential buildings. For example, painters may paint the walls and ceilings of family rooms, dining rooms, bedrooms, hallways, offices, and other interior surfaces. Similarly, painters paint exterior surfaces of homes and decks, office buildings, and other exterior surfaces either for decorating or for protecting surfaces from the elements. Painting projects often require great attention to detail, and some projects require large volumes of paint, stain, or any other fluid that is spreadable with a brush. Those types of projects can become particularly time consuming.

In the methods that are currently available and have long been used for painting projects, when a painter is prepared to paint a surface, he or she uses a paint brush similar to those available for sale on hardware and other store shelves. The painter dips the paint brush into a bucket of paint before beginning to paint a surface. The repeated motion of turning toward the paint container (e.g., a paint bucket) and dipping a paint brush into the bucket of paint before painting in a stroke-like pattern on any given surface can become quite time consuming during large projects, when the process of dipping and painting can go on for hours or days at a time.

Repeatedly transferring paint, stain, or any other fluid from a paint can or other container to a painting surface and then painting the surface can result in paint falling from the brush and onto the floor or other surrounding surface. This can lead to not only a surplus of wasted paint, but also a messy project space. Similarly, a painter managing both a paint can or other paint container and a paint brush can lead to a hazardous situation, especially when the painting project requires the use of a ladder. With all the back and forth motion associated with painting using traditional methods, there is an increased risk of knocking the paint container off the ladder, or of a painter falling from the ladder and injuring himself or those around him.

Humidity, heat, sunlight, wind and other environmental factors also determine how the quality of a particular paint job turns out. For example, when painting trim with a glossy surface, time dictates the quality of the finish and brush marks left behind. The more time it takes to paint a particular surface, and the more time it takes to recoat a paint brush with paint from a paint can, brush marks are often left behind. When steps are taken to eliminate the number of times of getting paint from a paint source to a particular surface to be painted, the painting process and finished appearance can have a greater visual appeal and effect. For example, when dipping a paint brush into paint and going back and forth to an area just brushed, many things can happen if not done in a timely fashion. Back pedaling to blend paint and brush marks evenly onto a particular surface can leave very noticeable deeper brush marks or grooves during this process. In addition, the use of a particular type of paint such as a glossy paint, a semi-gloss paint, a satin finish paint and so forth will also drastically affect the attempt to blend both the paint and brush marks evenly during a particular painting project. These brush marks and grooves can often times be seen at a distance due to light changes and depending upon the angle of view of that particular surface. Continuous brushing would eliminate these factors and greatly reduce the need for back pedaling to blend paint and brush marks evenly into a particular painted surface.

Existing "solutions" for the time-consuming and potentially dangerous traditional painting methods are not effective. For example, automatic power paint sprayers often require a heavy-duty air compressor, which can be cumbersome at a painting project site. The power sprayers are also subject to air pressure that is difficult to control, and the likelihood of "overspraying" is greatly increased. Also, the sprayers lack the fine control that is only available with traditional brushes, and it is nearly impossible to properly paint corners and detailed structures that require delicate, precise strokes with the existing sprayer systems.

Such sprayer systems are also difficult to clean. Any time saved by the power sprayer machines being able to powerfully and voluminously distribute paint to a paint surface is negated by time associated with cleaning both the sprayer tip, its associated tubing, the sprayer mechanism and the container used to store paint prior to its being sprayed.

When painting trim with intricate detail or long stretches of a particular surface to be painted, it is desirable to use continuous brush strokes over such surfaces so as to reduce the time necessary to complete the painting of that particular surface thereby avoiding visible brush strokes in the painted surface as well as reducing the painter's back and forth motion between the paint container and the brush to accomplish the particular task. Reducing the number of steps to complete a particular paint project likewise reduces the time involved as well as the quality of the finished product.

It is therefore desirable to provide a paint brush transfer system that is compact, easy to use, and efficient at distributing paint to a paint surface, thus reducing the work that needs to be performed by a painter. It is also desirable to provide a paint transfer system that enables continuous brushing of a particular surface to be painted and is likewise easy to clean and easy to prepare for the next painting project. Such a system not only reduces the overall time to complete a particular project, but it should also eliminate the need to carry around an open paint container in close proximity to a painter's brush hand.

Accordingly, the present invention is directed to overcoming one or more of the problems set forth above.

SUMMARY OF THE INVENTION

The present invention provides for a paint transfer system that may be used by a professional painter or homeowner to more efficiently and cleanly complete a painting project. The present paint transfer system generally includes some type of a paint container for storing paint, stain or any other fluid that can be applied to a particular surface using a brush having a pump device associated therewith wherein the paint container is coupled in fluid communication with the pump device. A paint brush apparatus is also coupled in fluid communication with the pump device, and/or paint container such that when the pump device is activated, paint is supplied from the paint container to the paint brush apparatus. In one embodiment, the paint container, pump mechanism, and paint brush apparatus are coupled together via flexible tubing. The present paint transfer system can be either manually or automatically activated by the user.

In one aspect of the present invention, a first automatic paint transfer system includes a carrier member, a remote control member, and a paint brush apparatus wherein the carrier member, remote control member and paint brush apparatus are coupled with one another, for example, via flexible tubing. The carrier member includes a paint container or other storage member that stores and contains paint, stain or other fluid that will eventually be applied to a surface to be painted or stained as well as a pump device. The paint container member is preferably coupled to the pump member by way of tubing. Tubing from the pump member leads to the paint brush apparatus and activation of the pump member is controlled through the use of the remote control member which allows a painter to selectively control the flow of paint or stain to the paint brush apparatus. The paint brush apparatus includes a paint brush with bristle members as well as other flow control members.

In operation, when a painter depresses a button associated with the remote control member, the pump member associated with the carrier member is activated. Paint is drawn from the paint container member to the pump member, where the pump's actions cause paint or stain to be pumped through the associated tubing toward the paint brush apparatus. Paint or stain may exit the paint brush apparatus by way of a bladder that is provided within the bristle members of the paint brush. The bladder allows paint or stain that is ejected from the paint brush to be evenly distributed prior to its application. Paint or stain being evenly distributed within the bristle members of a paint brush reduces the likelihood that streaks or brush marks will be visible on a surface to be painted. Flexible tubing and other valve control members are located within the paint brush along with the bladder member to control the distribution of paint or stain from the paint brush.

Several alternative manual paint transfer systems are also provided. In the various manual paint transfer systems disclosed herein, a paint brush apparatus substantially similar to that used with the automatic paint transfer system is utilized. The paint brush apparatus is coupled in fluid communication with one of several different types of manual pumping devices or, in one embodiment, with a roll-up bag mechanism for squeezing paint or stain out of the bag to the paint brush apparatus. The different types of pumping devices may range from a pressure-driven pump to a pneumatic-driven pump, to a ratcheted pump, to a piston-driven pump. In all of the various embodiments disclosed herein, the manual pumping device is associated with the paint container and is coupled to the paint brush apparatus such that as the pump is operated by a painter, paint is provided to the bristle members of the paint brush. As in the case of the automatic paint transfer system, the paint brush apparatus associated with the various embodiments of the manual paint transfer systems functions and operates similar to the paint brush apparatus associated with the automatic system and likewise includes a bladder in the bristle members of the paint brush for supplying paint thereto.

In the one embodiment where a manual roll-up bag mechanism is utilized for squeezing paint or stain out of the bag to the paint brush apparatus, a gear mechanism is utilized in conjunction with the present paint bag to manually roll-up the paint bag onto a roller member whereby paint or stain is squeezed or forced to the bottom of the paint bag during the roll-up process thereby forwarding the paint or stain to the paint brush apparatus. The bottom of the roll-up paint bag is in fluid communication with the paint brush apparatus as previously described and a user can manually engage the gear mechanism so as to selectively control both the speed and the amount of roll-up of the bag onto the roller mechanism during a particular painting operation.

In addition, the present paint container members are specifically designed for use with the various transfer systems disclosed herein and each includes a quick connect/disconnect mechanism for attaching to the various pump mechanisms disclosed herein such that a painter can easily change paint container members during a particular project such as, for example, changing paint colors from one wall surface to another wall surface, or changing the paint container member when the paint or stain in one container member is emptied. In similar fashion, quick disconnect members are likewise associated with one end portion of the paint brush apparatus and the connecting tube member for likewise allowing a user to quickly change out brushes as needed, for example, changing the brush shape or brush size depending upon the particular surface to be painted.

Other mechanisms such as the various embodiments of a paint brush protector which can be used both during the painting process as well as for storage of a particular paint brush are also disclosed. In one embodiment, the paint brush protector includes an air tight bag or jacket member which slips over the bristle members of a particular paint brush for storage. In another embodiment, the paint brush protector includes a clamping mechanism with moisture absorbent pads or other moisture holding materials associated therewith for clamping around the bristle members of a paint brush in use so as to keep the brush moist while moving from one location to another, or while in temporary non-use.

Other applications and uses of the various embodiments of the present paint transfer system and its associated accessories will be evident to a person skilled in the art after reading the detailed description of the present invention and the accompanying drawings.

DESCRIPTION OF THE DRAWINGS

For a better understanding of the various embodiments of the present invention, reference may be made to the accompanying drawings in which.

DETAILED DESCRIPTION OF THE INVENTION

Figure 1:
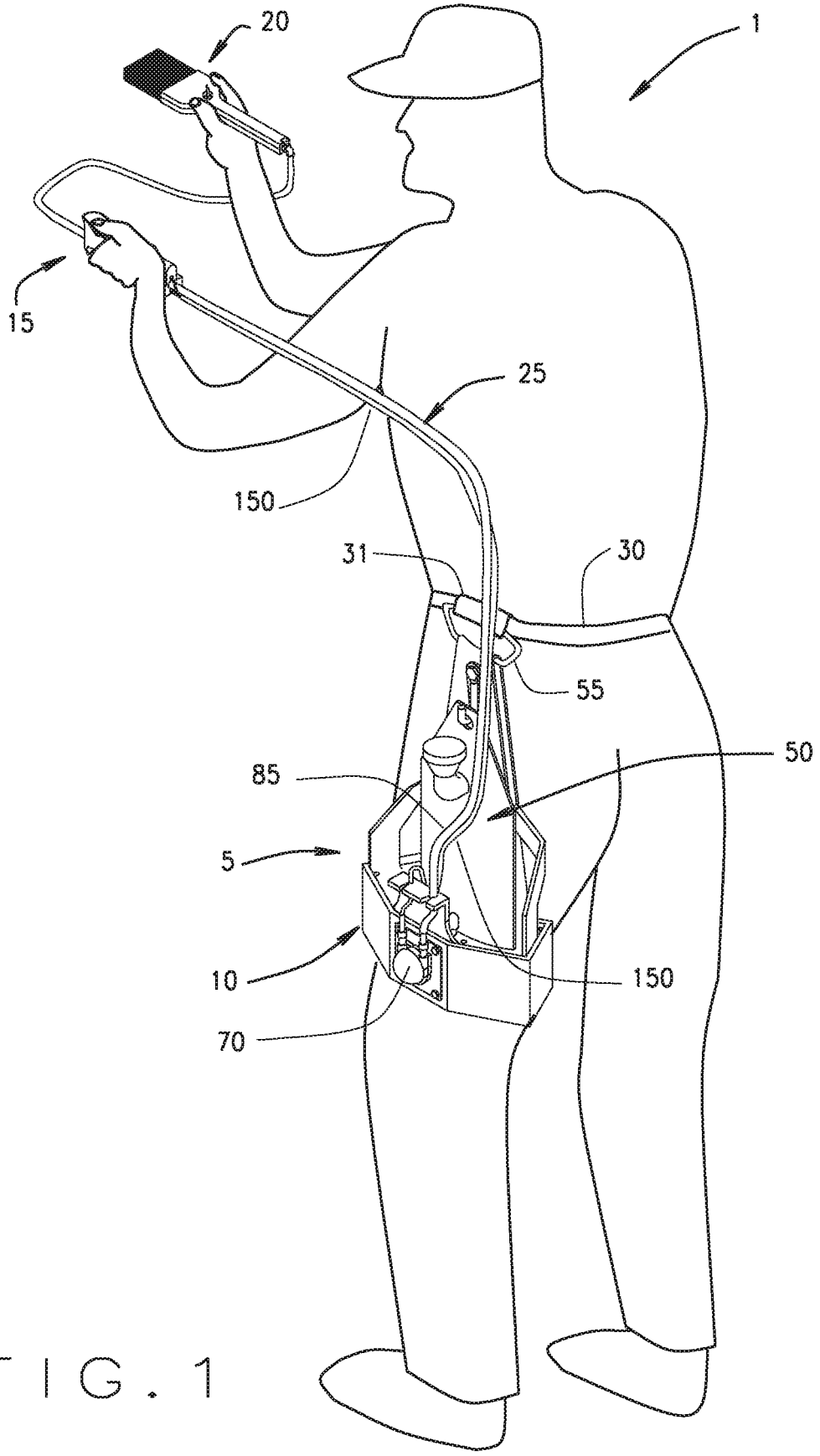
FIG. 1 is a perspective view of a painter using one embodiment of an automatic paint transfer system constructed according to the teachings of the present invention.

FIG. 1 illustrates a painter 1 using an automatic paint transfer system 5 constructed according to the teachings of the present invention to paint and/or stain an interior wall surface, ceiling, exterior structure, household furniture, or other paintable or stainable surface. The present system 5 can also be used to apply any type of fluid or other substance that is spreadable or applyable using a brush. Automatic paint transfer system 5 generally includes a carrier member 10, remote control member 15, and paint brush apparatus 20. A fluid conduit such as flexible tubing 25 may fluidly couple, or connect, carrier member 10 with paint brush apparatus 20. As will be described in greater detail below, painter 1 may use remote control member 15, which is electronically connected to a pump member, to control the flow of paint contained in carrier member 10 to paint brush apparatus 20 when painter 1 is ready for paint, stain or other substance to be supplied to paint brush apparatus 20 prior to application to a surface.

Figure 2:
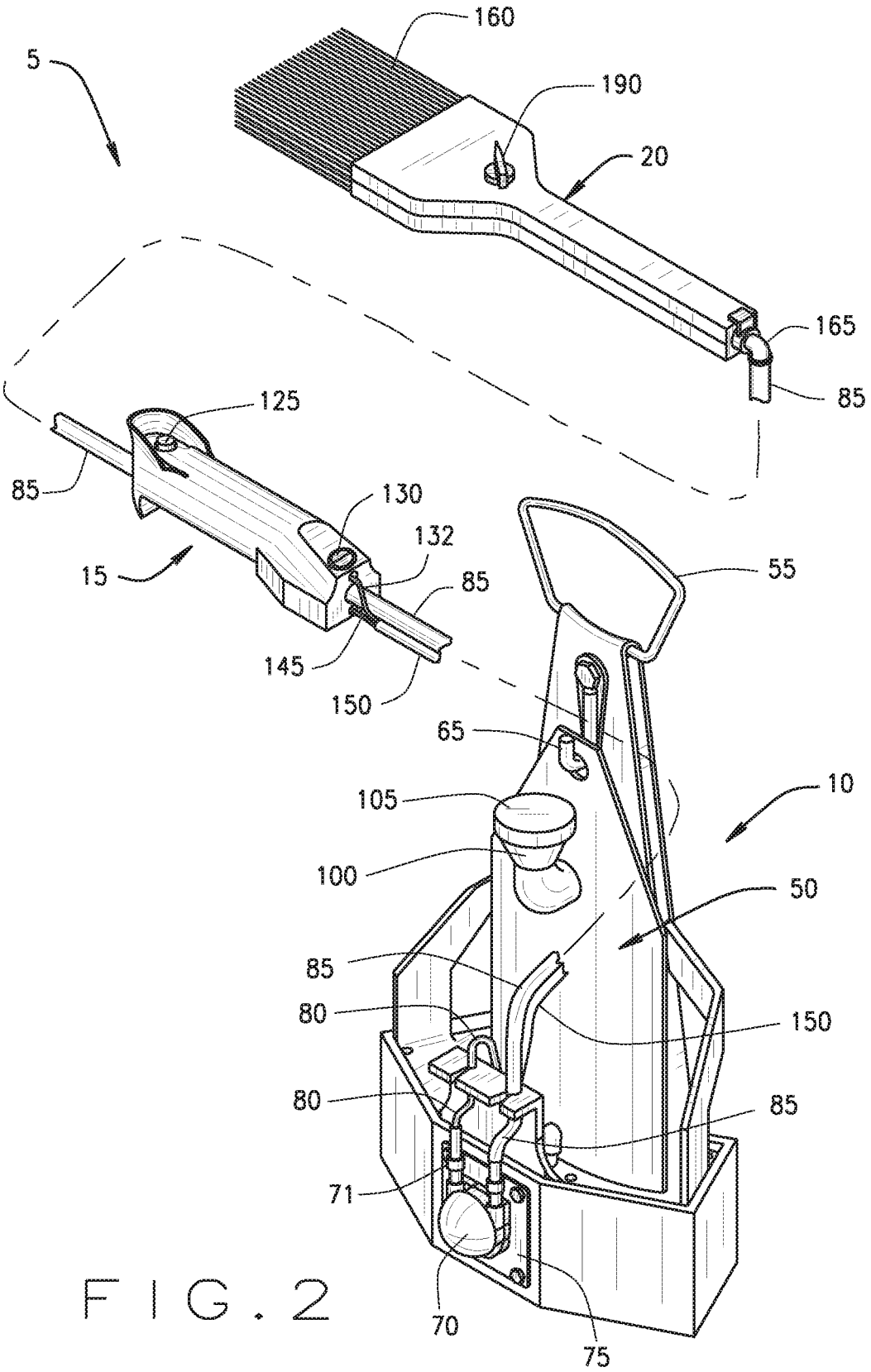
FIG. 2 is an exploded view of the automatic paint transfer system of FIG. 1.

As shown in FIG. 1, carrier member 10 may be attached to a belt 30 worn by a painter such as painter 1 in any conventional manner such as through the use of clip member 31. When worn on belt 30, carrier member 10 may ergonomically sit on the hip of painter 1 such that it is out of the way when painter 1 is painting a given surface. Carrier member 10 may also be worn in a backpack configuration, it may be placed on the ground, or it may otherwise be positioned out of the way of painter 1 to provide painter 1 with a sufficient range of motion. FIG. 2 provides an exploded view of the automatic paint transfer system 5 with tubing 25 shown in broken portions.

Figure 3:
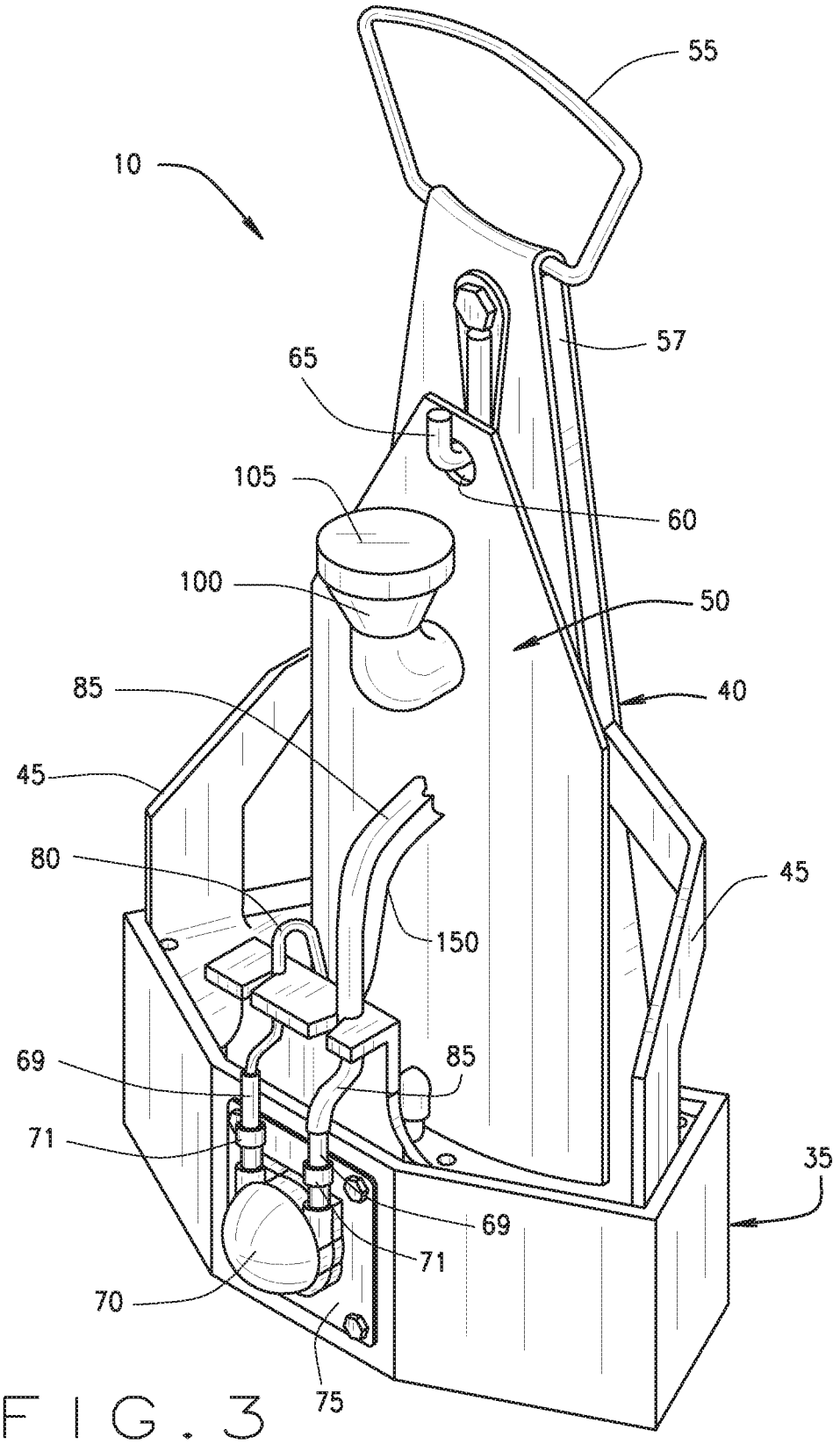
FIG. 3 is a perspective view of the carrier member associated with the automatic paint transfer system of FIGS. 1 and 2.
Figure 4:
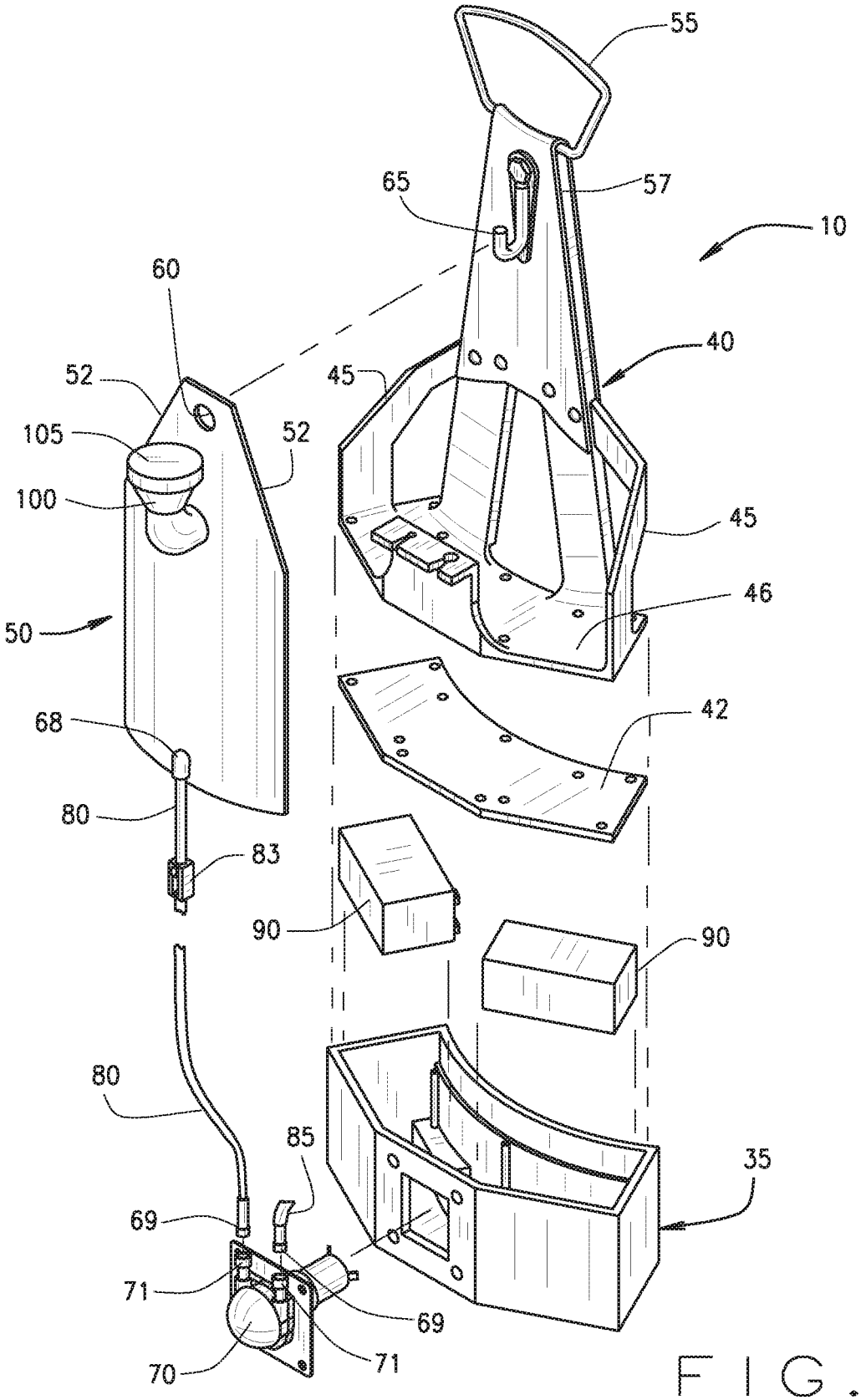
FIG. 4 is an exploded view of the carrier member of FIG. 3.
Figure 5:
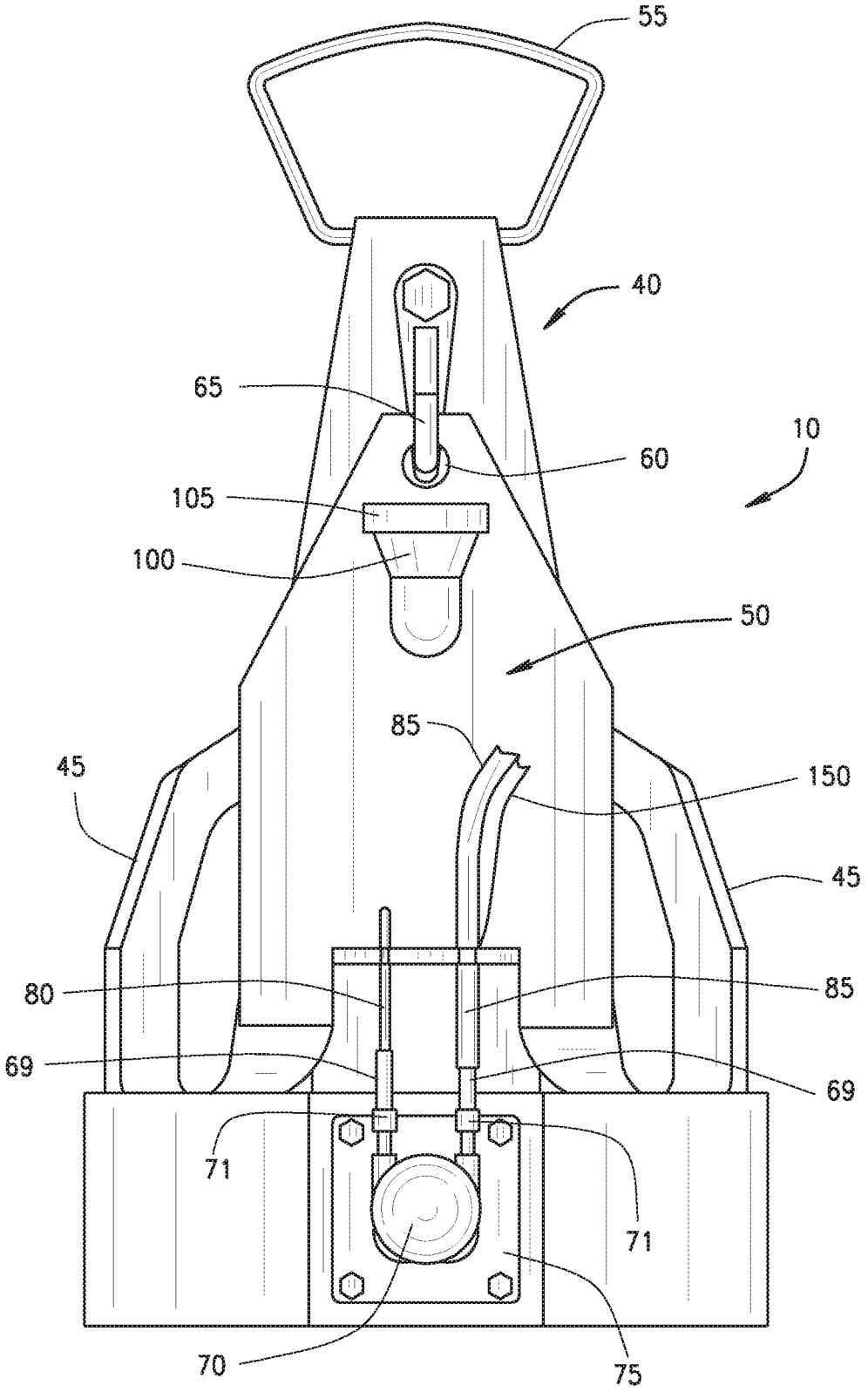
FIG. 5 is a front elevational view of the carrier member of FIGS. 3 and 4.
Figure 6:
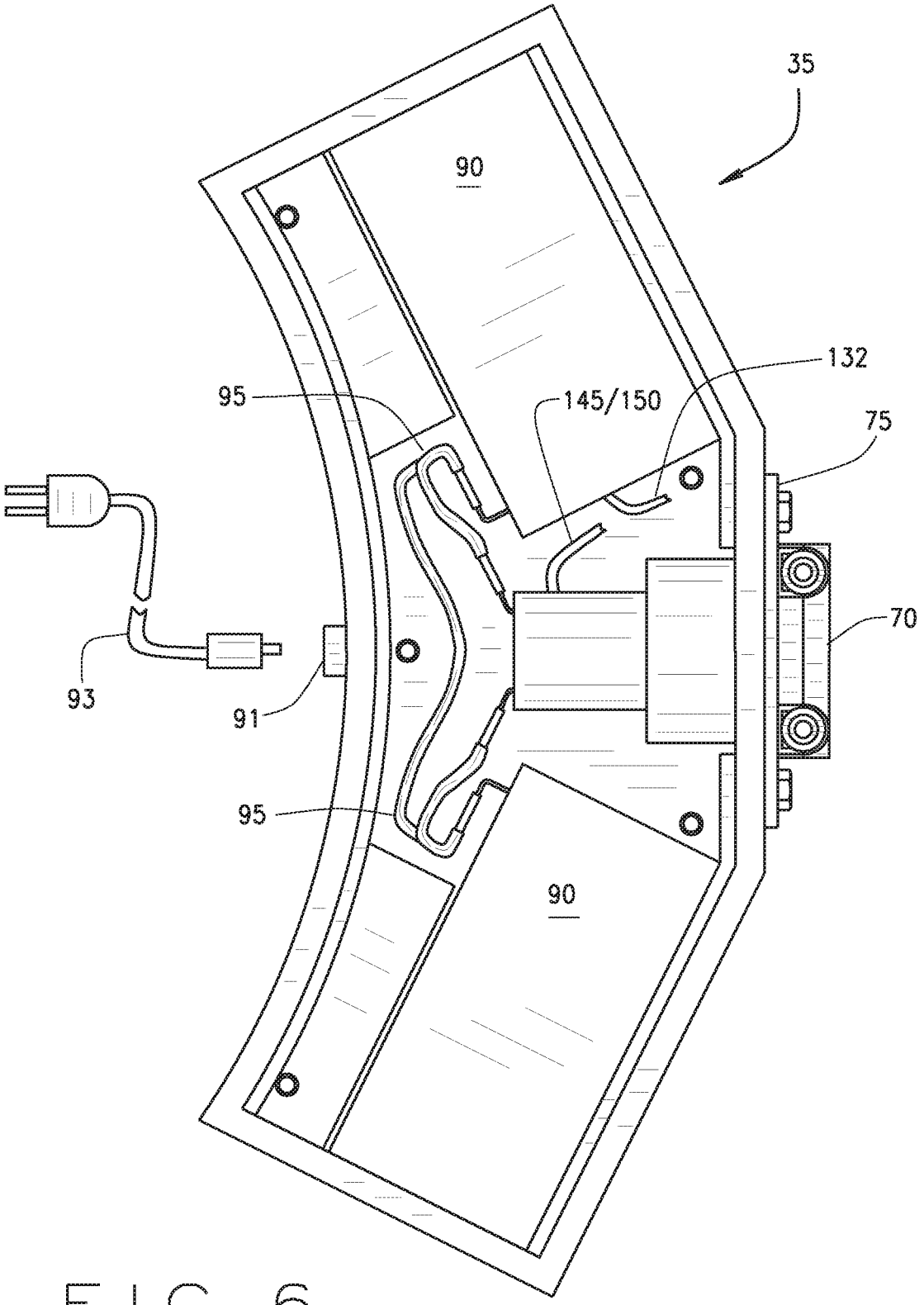
FIG. 6 is atop plan view of the carrier member of FIGS. 3-5.

FIG. 3 is a perspective view illustrating one embodiment of carrier member 10. FIG. 4 provides an exploded view of carrier member 10; FIG. 5 illustrates a front elevational view of carrier member 10; and FIG. 6 illustrates a top plan view of the interior of carrier member 10. Reference will be made to FIGS. 3-6 in describing the various components of carrier member 10.

Carrier member 10 includes a base member 35 for holding and/or containing various electronics and an upper support member 40. A platform member 42 may be releasably attachable to both the base member 35 and upper support member 40 so as to protect components within base member 35 from the elements and other hazards. Platform member 42 is preferably attached to base member 35 and upper support member 40 is attached to platform member 42 in a conventional manner such as by screws or other fastening means. Upper support member 40 may include arm portions 45 for preventing a paint container member 50 associated with carrier member 10 from being subjected to excessive lateral movement. Paint container member 50 may be a bag, pouch or any other paint holding member that is used to store paint until it is ready for use. Paint container member 50 will be described in greater detail hereinbelow when describing FIG. 7.

An attachment loop 55 of carrier member 10 may be engaged with another loop 57 formed in upper support member 40, and attachment loop 55 may further be releasably secured with belt 30 of a painter via clip member 31 or any other belt attachment mechanism. Attachment loop 55 may also be useful for carrying or otherwise toting carrier member 10 from one location to another while working on a painting project or while preparing to begin a project.

Paint container member 50 preferably includes an upper aperture 60 for releasably engaging a hook member 65 associated with upper support member 40 as best shown in FIGS. 4 and 5. Attaching paint container member 50 to hook member 65 provides a stable holding mechanism for container member 50 and allows member 60 to fit and rest within the space formed between arm positions 45 and floor portion 46 of upper support member 40. This arrangement stabilizes the paint container member 50 within the carrier member 10 and may also help to prevent paint container member 50 from jostling or otherwise moving during the painting process, thus reducing the likelihood of paint spillage. The weight of the paint container member 50 rests on floor portion 46 and reduces the strain of the container member 50 hanging from hook member 65.

Base member 35 of carrier member 10 further includes a pump device 70 for pumping paint contained within container member 50 to paint brush apparatus 20 by way of tubing 25. Pump device 70 is preferably a peristaltic pump, as commonly known and understood in the art. Pump device 70 preferably includes a rotor with a cam (not illustrated), and as the rotor rotates, the cam will be in contact with tubing 25 that runs through the pump device 70, and oblong portions of the cam may intermittently compress tubing 25. Tubing 25 being intermittently compressed and subsequently decompressed as it comes in and out of contact with the cam forces fluids to be pumped such that paint moves through tubing 25. This compression and decompression of the tubing 25 by the pump cam is normal operation for a peristatic pump. As tubing 25 opens to its natural state after the cam passes, fluid flow will be induced to tubing 25, thus resetting the peristaltic process described above. While other pump types are envisioned, the WELCO® WPX1 peristaltic pump, which is commercially available, is used in the preferred and illustrated embodiment. Electronics and wiring associated with the pump device 70 are shown in FIG. 6 and described in more detail below. Other pump devices may also work equally as well so long as the controller 15 controls the pump and the amount of paint dispensed from the container member 50.

Pump device 70 may be mounted to base member 35 via mounting plate 75 as best shown in FIGS. 3-6. When pump device 70 is mounted to base member 35 of carrier member 10 via plate 75, electronic components associated with pump 70 will be located on an interior portion of base member 35 as best illustrated in FIG. 6 such that those electronic components are protected from the elements and other particulate matter that could cause damage to pump 70. This arrangement also allows for easy electrical connection to the batteries 90 and other electrical components housed within base member 35.

Tubing 25 includes bag or paint container tubing 80 and brush tubing 85. Bag tubing 80 is coupled with and provides fluid communication between paint container member 50 and pump 70, while brush tubing 85 is coupled with and provides fluid communication between pump 70 and paint brush apparatus 20. Tubing 80 and tubing 85 are shown in "broken" form in FIGS. 3 and 5 and also include quick connect/disconnect couplings at their respective opposite end portions, as will be hereinafter further explained, to connect and disconnect from the paint brush apparatus 20 and the pump device 70.

FIG. 6 better illustrates internal components associated with base member 35 of carrier member 10 and pump device 70. Because pump device 70 is an electronic pump, a power source must provide power to pump 70. In the illustrated embodiment, two battery devices 90 provide power to pump 70 when automatic paint transfer system 5 is in use. Preferably pump device 70 is a 24V pump, and therefore each of battery members 90 are 12V batteries connected in series with pump 70. As commonly known and understood in the art, other power methods may be used, and other magnitudes of power may be used, to provide pump 70 with the necessary voltage.

Electronic wiring 95 electronically connecting pump 70 and battery members 90 is further illustrated in FIG. 6. Electronic wiring 145 from pump member 70 is also in electrical communication with remote control member 15 such that painter 1 may use remote control member 15 to activate pump 70 and pump paint to paint brush apparatus 20 when desired, as described herein below in greater detail. In addition, exterior plug outlet 91 is available to recharge battery members 90 when necessary. In this regard, a conventional recharging unit 93 as shown in FIG. 6 can be used to recharge battery members 90. Recharging outlet 91 is coupled to battery members 90 in a conventional manner. It is recognized and anticipated that any known recharging circuitry and configuration can be utilized and incorporated into base member 35 for recharging battery members 90.

Figure 7:
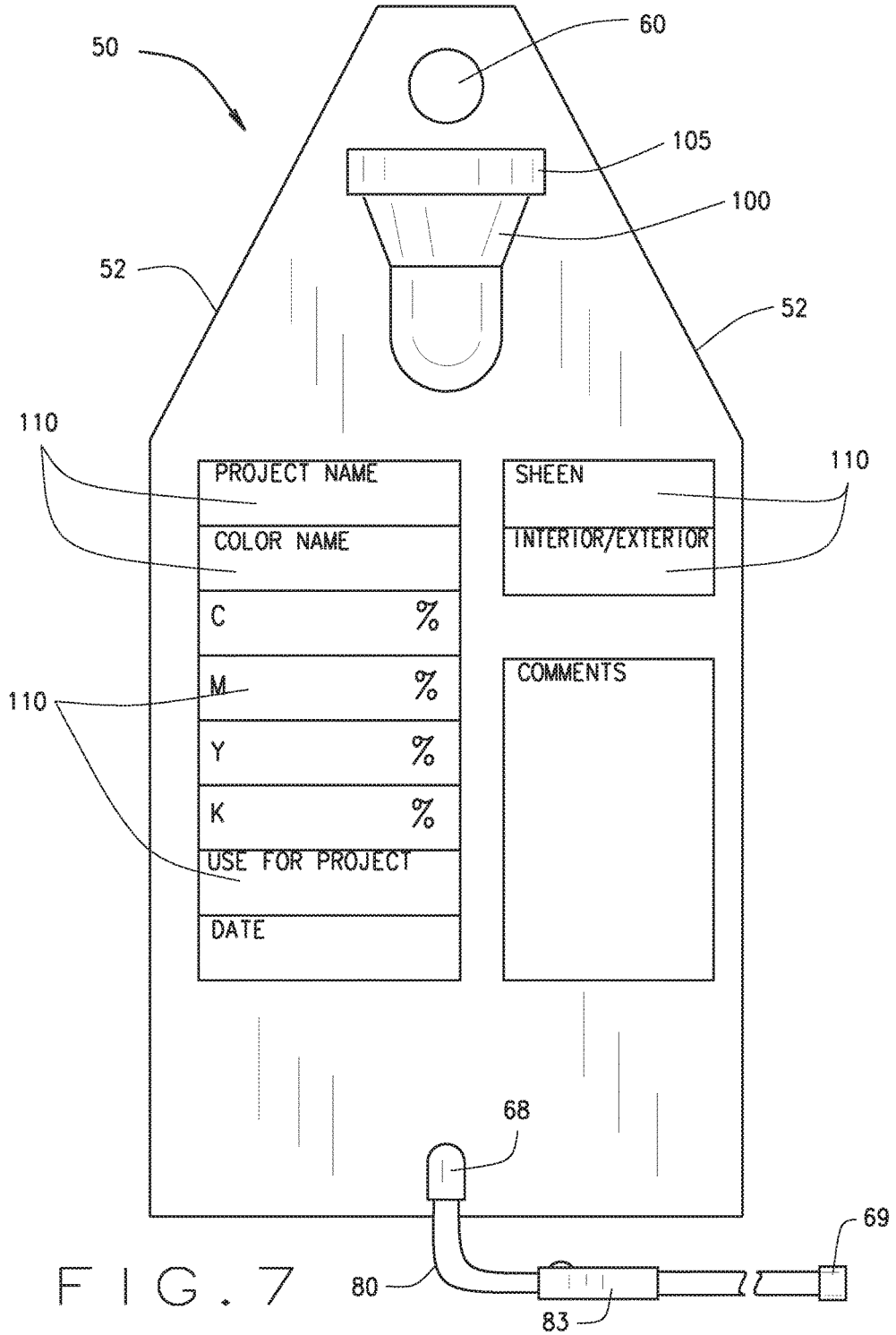
FIG. 7 is a front elevational view of one embodiment of a paint container member associated with the carrier member of FIGS. 3-6.
Figure 8:
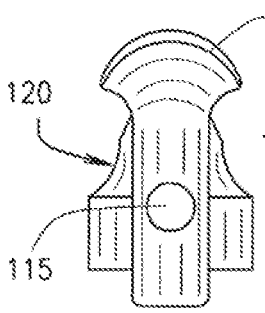
FIG. 8 is a rear elevational view of one embodiment of a remote control member associated with the automatic paint transfer system of FIGS. 1 and 2.

FIG. 7 illustrates one embodiment of a paint container member 50 that may be utilized with the present automatic paint transfer system 5 for holding and containing the paint to be used with the present system. Paint container member 50 preferably includes a fluid chamber or inlet opening 100 for receiving paint, stain or any other spreadable substance poured into paint container member 50 and a cap member 105 associated with fluid chamber 100 to prevent paint spillage from the container 50. Paint container member 50 is preferably a bag, as shown in the illustrated embodiments, although alternative embodiments can include a pouch or any other container that will adequately hold paint. Any suitable container is foreseeable. The container member 50 also includes an exit opening and coupling member 68 located at the bottom of the container (FIG. 7) for coupling to bag tubing 80 for providing fluid communication from the container 50 to the pump 70 as best illustrated in FIG. 3. Bag tubing 80 also includes a stop member or an open/close valve 83 for sealing the tube 80 at the location of stop member 83. Any conventional stop member or open/close valve can be used to pinch tube 80 thereby preventing the flow of paint from paint container member 50 to the paint brush apparatus 20 and vice versa. This allows a user to control the flow of paint from the container member 50 to pump device 70 so that the flow can be stopped when it is necessary to switch out paint container member 50 for replenishing an empty container, changing colors or storing unused paint at the end of a project. In this regard, one embodiment of a stop member 83 could include a channel member for receiving the bag tubing 80 and a roller member movably mounted on a pair of tracks located above the channel. The tracks are inclined from one end of the channel to the other such that as the roller member is moved along the channel, the roller member will contact the tube 80 and will eventually close, pinch, or seal off the tube 80 as the roller member is moved from end of the channel to the other. Other stop members can likewise be used to accomplish the same task. A quick connect/disconnect coupling member 69 known in the art can be located downstream from stop member 83 for easily connecting and/or disconnecting bag tubing 80 to the pump member 70 for allowing the container member 50 to be easily and quickly replaced. The coupling member 69 is cooperatively engageable with a corresponding coupling member 71 associated with pump device 70 as best illustrated in FIG. 4. Preferably, container member 50 is disposable, and its interior surface is resistant to paint so that paint does not stick to the interior surface and is easily pumped therefrom during operation. Container member 50 can be made of a transparent material such as a plastic or vinyl, and preferably of a material of which paint and/or stain will not readily adhere to.

Paint container member 50 may also include a plurality of paint characteristic data boxes 110 that a painter 1 may use to label the contents of paint container member 50. For example, as shown in FIG. 7, identifying various characteristics of the paint housed within container 50 may include project name, paint color name, and key percentages of the colors used to obtain the desired paint color mixture, date, sheen, interior/exterior notes and any other comments the painter may want to make regarding the project. Other data and indicia may likewise be used to identify the paint and the project for storage and future use. The paint container member 50 may also include tapered upper side portions 52 for further facilitating the flow of paint to exit opening and coupling member 68 and for stabilizing the container member 50 in carrier member 10.

FIGS. 8-13 provide various views of one embodiment of the remote control member 15 for operating pump 70. Remote control member 15 is preferably ergonomically shaped, as shown in FIGS. 8-13, such that painter 1 may comfortably hold remote control member 15 while also holding paint brush apparatus 20. At the same time, carrier member 10 is preferably attached to painter 1, for example, by way of belt 30 being engaged with attachment loop 55 and clip member 31 as shown in FIG. 1.

Figure 12:
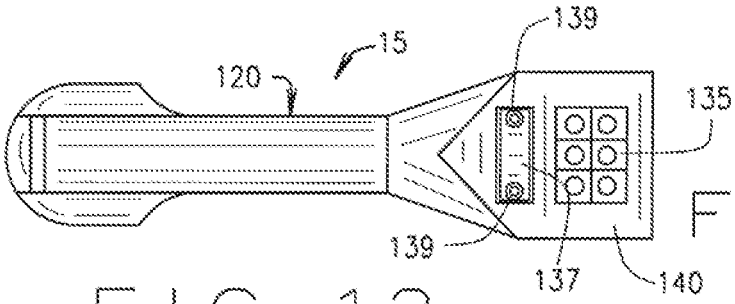
FIG. 12 is a bottom plan view of the remote control member of FIGS. 8-11.

Remote control member 15 preferably includes a body member 120 which includes a central tunneled portion or passageway 115 for receiving brush tubing 85 which extends through the entire length of remote control member 15. This allows the brush tubing 85 to be easily held in conjunction with the remote control member 15 when a painter is using the present system 5. Remote control member 15 includes a first activation trigger 125 associated with the upper portion of body member 120 for activating pump 70. Activation trigger 125 is shown in the illustrated embodiment as a button but could include any activation device such as a slide switch or other on/off mechanism. Activation trigger 125 is recessed within an opening 126 so as to prevent accidental engagement. In addition, activation trigger 125 is also partially surrounded with a skirt or flange 127 as illustrated to further protect activation trigger 125 from being accidentally engaged. Body member 120 also preferably includes a second activation trigger 130 for activating a flashlight 135 which is positioned and located on a lower portion 140 of body member 120. In the illustrated embodiment, second trigger 130 is an on/off switch and is electrically connected to flashlight 135 (FIG. 12). Second activation trigger 130 is electrically connected to the batteries 90 via wiring 132. Alternative activation mechanisms for activation trigger 130 are likewise envisioned. Flashlight 135 is preferably an LED array, but other sufficiently bright types of light are also foreseeable.

Figure 9:
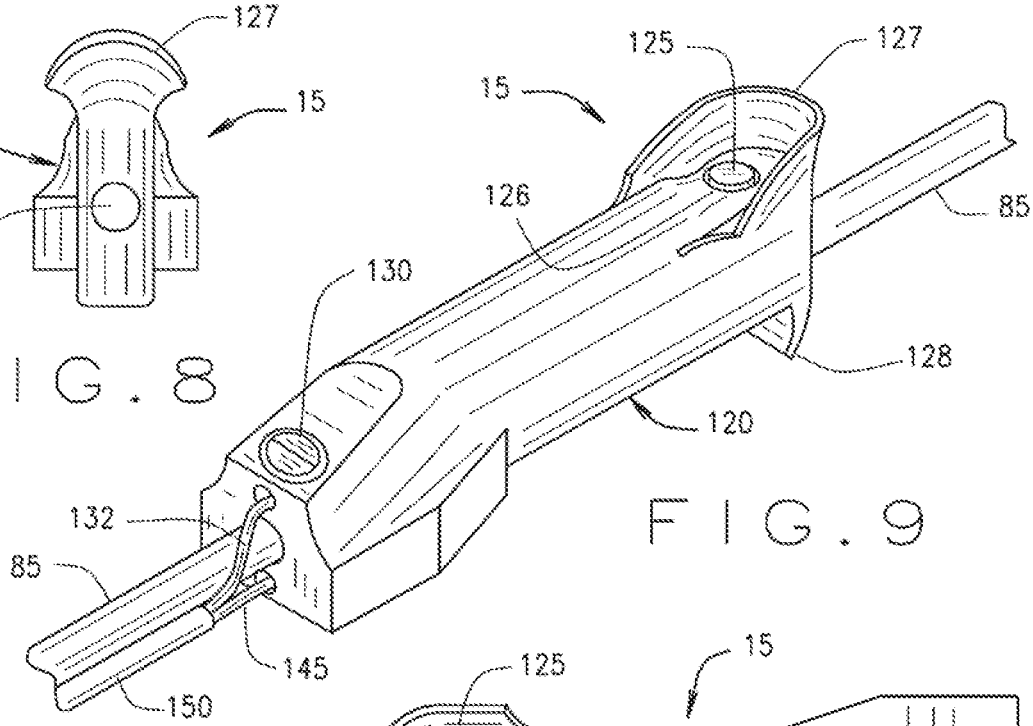
FIG. 9 is a perspective view of the remote control member of FIG. 8.
Figure 10:
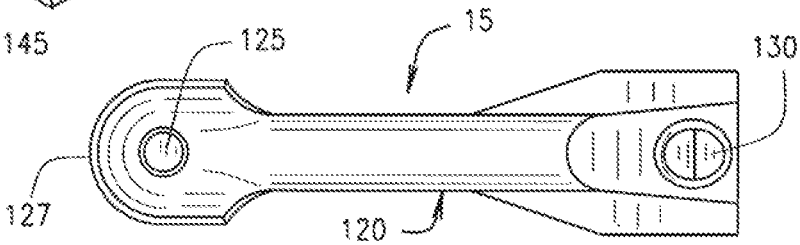
FIG. 10 is a top plan view of the remote control member of FIGS. 8 and 9.
Figure 11:
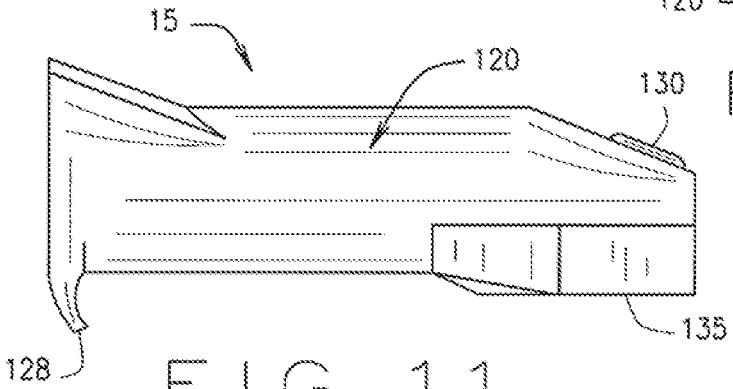
FIG. 11 is a side elevational view of the remote control member of FIGS. 8-10.
Figure 13:
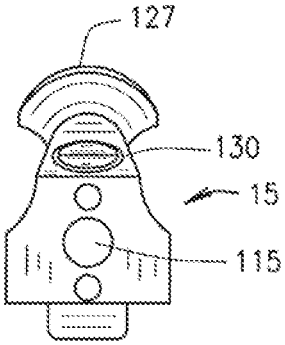
FIG. 13 is a front elevational view of the remote control member of FIGS. 8-12.
Figure 14:
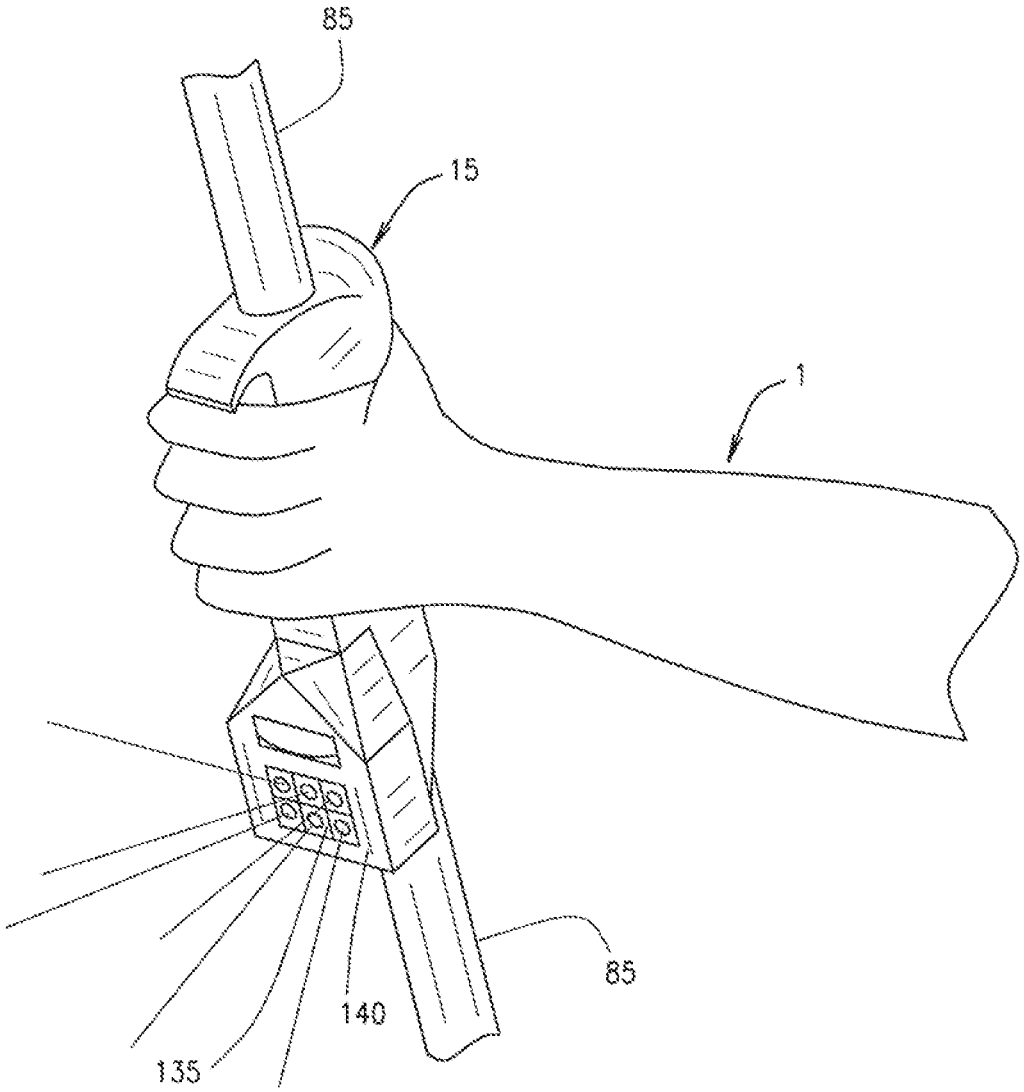
FIG. 14 is a perspective view of a painter utilizing the flashlight member associated with the remote control member of FIGS. 8-13.

As shown in FIG. 9, remote control member 15 is associated with wiring 145 and 132. Wiring 145 and 132 may be surrounded by protective sheathing 150 and may run the length of brush tubing 85 until it reaches carrier member 10 as best shown in FIGS. 1 and 2, where wiring 145 is preferably electrically connected to pump 70 inside of carrier member 10 and wiring 132 is electrically coupled to batteries 90. The electronic circuitry associated with activating pump 70 through button or switch 125 and flashlight 135 through switch 130 is known and understood in the art such that power may be provided from battery members 90 to either of pump 70 and/or flashlight 135, when activation triggers 125 and/or 130 are engaged. First activation trigger or switch 125 is used to activate pump 70 and second activation trigger or switch 130 is used to activate flashlight 135. FIG. 14 illustrates a painter 1 holding remote control member 15 upright so as to use flashlight 135 to illuminate a workspace such as a shadowed corner that makes a surface difficult to paint due to insufficient lighting. The flashlight 135 is positioned and located towards the rear underside portion 140 of body member 120 as illustrated in FIGS. 11, 12 and 14 so that a painter can easily rotate the remote controller 15 as shown in FIG. 14 for operative use while still engaging the trigger or switch 125 to operate pump 70.

Remote control member 15 also includes an ergonomically configured finger or projection 128 which allows a user to rest a finger thereagainst to support and reduce the overall weight of the control member 15 while holding the control member 15 in an elevated position such as illustrated in FIG. 14. In addition, as best illustrated in FIG. 12, remote control member 15 also includes an adjustable clamp member 137 which is positioned in alignment with the passageway 115 such that brush tubing 85 can be engaged with clamp member 137. Clamp member 137 includes clamping/unclamping means such as the fasteners 139 illustrated in FIG. 12 for both tightening and untightening clamp member 137 relative to brush tubing 85. Untightening or loosening clasp member 137 from brush tubing 85 allows a user to slide remote control member 15 along the length of brush tubing 85 as best illustrated in FIG. 1 so that the remote control member 15 can be positioned at a convenient location for the user based upon the particular task at hand and the amount of slack in brush tubing 85 preferred by the user. Once the remote control member 15 is properly located along brush tubing 85 between the paint brush apparatus 20 and the carrier member 10, the clamping/unclamping means such as fasteners 139 can be tightened around tubing 85 to hold the remote control member 15 at that location.

Figure 15:
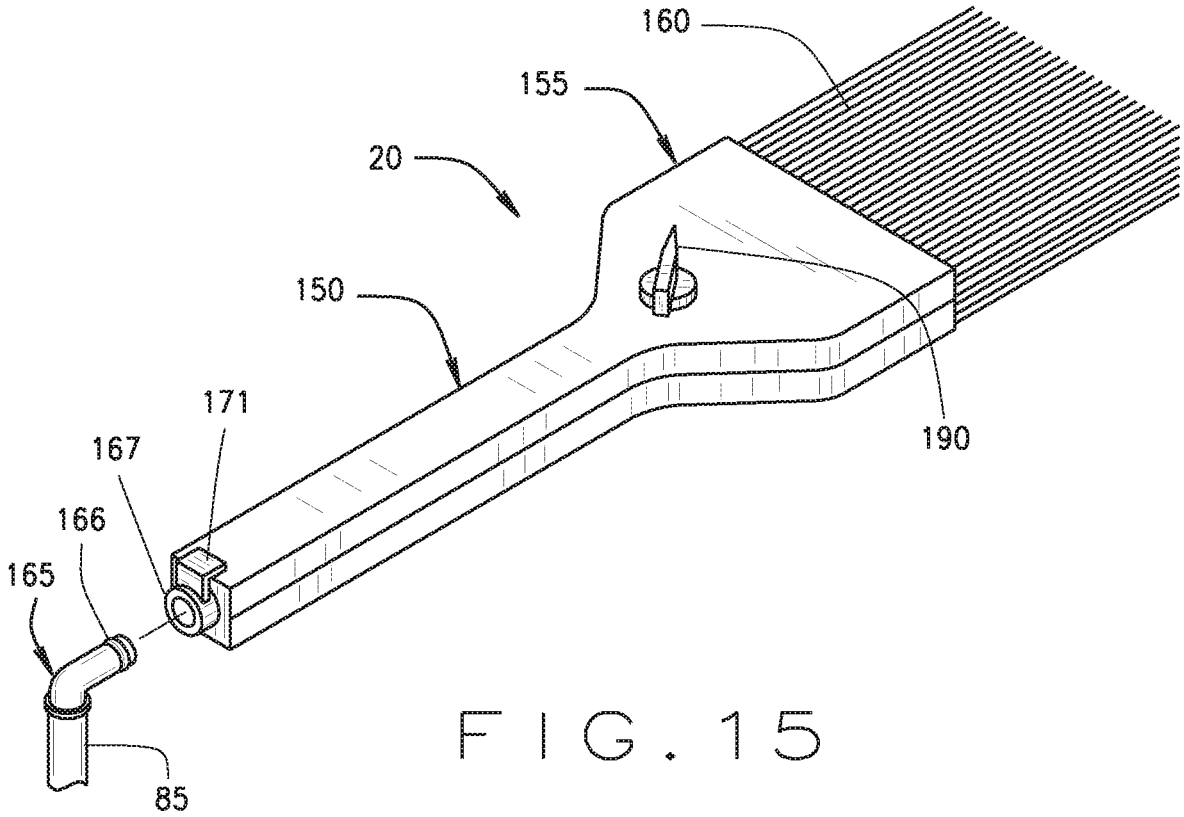
FIG. 15 is a perspective view of a paint brush apparatus associated with the automatic paint transfer system of FIGS. 1 and 2.
Figure 16:
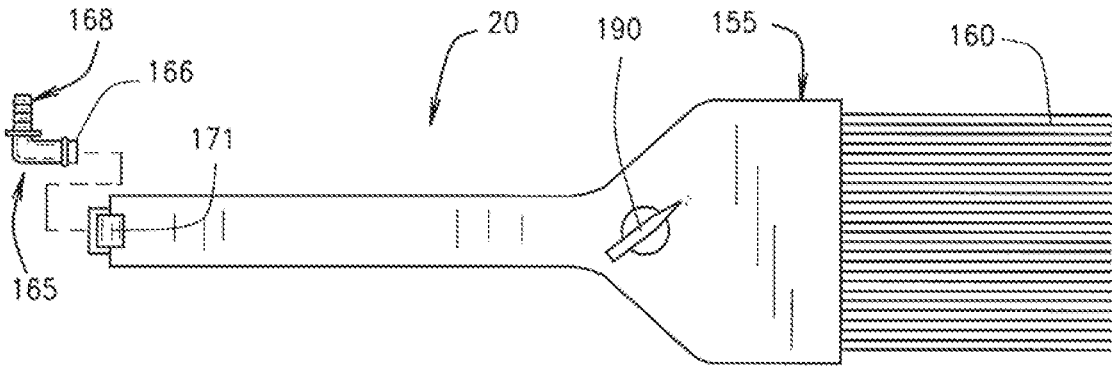
FIG. 16 is a top plan form view of the paint brush apparatus of FIG. 15.
Figure 17:
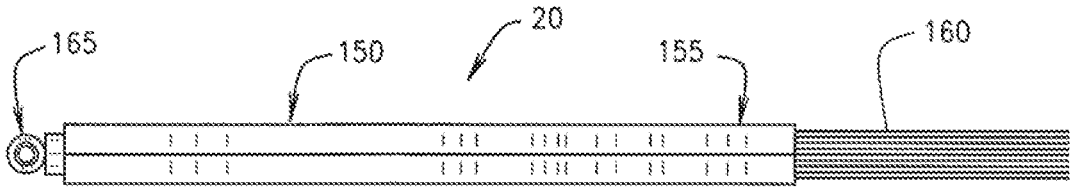
FIG. 17 is a side elevational view of the paint brush apparatus of FIGS. 15 and 16.
Figure 18:
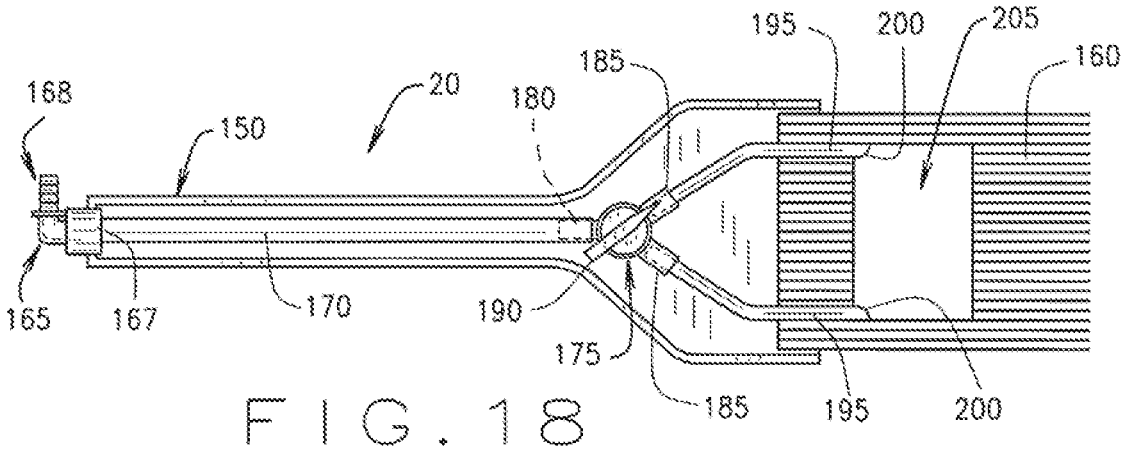
FIG. 18 is a cross-sectional view of the paint brush apparatus of FIGS. 15-17.

FIGS. 15-18 illustrate various views of one embodiment of the present paint brush apparatus 20 associated with the present automatic paint transfer system 5. FIG. 15 illustrates a perspective view of paint brush apparatus 20; FIG. 16 illustrates a top plan view of paint brush apparatus 20; FIG. 17 illustrates a side elevational view of paint brush apparatus 20; and FIG. 18 illustrates a cross-sectional view of paint brush apparatus 20. As shown in FIGS. 15-18, paint brush apparatus 20 includes a plurality of components that are typically used with paint brushes known and understood in the art. For example, paint brush apparatus 20 includes a handle portion 150, a base portion 155, and a plurality of bristle members 160. Bristle members 160 may be made of a natural or a synthetic fiber, as commonly used in commercially available paint brushes.

Figure 15A:
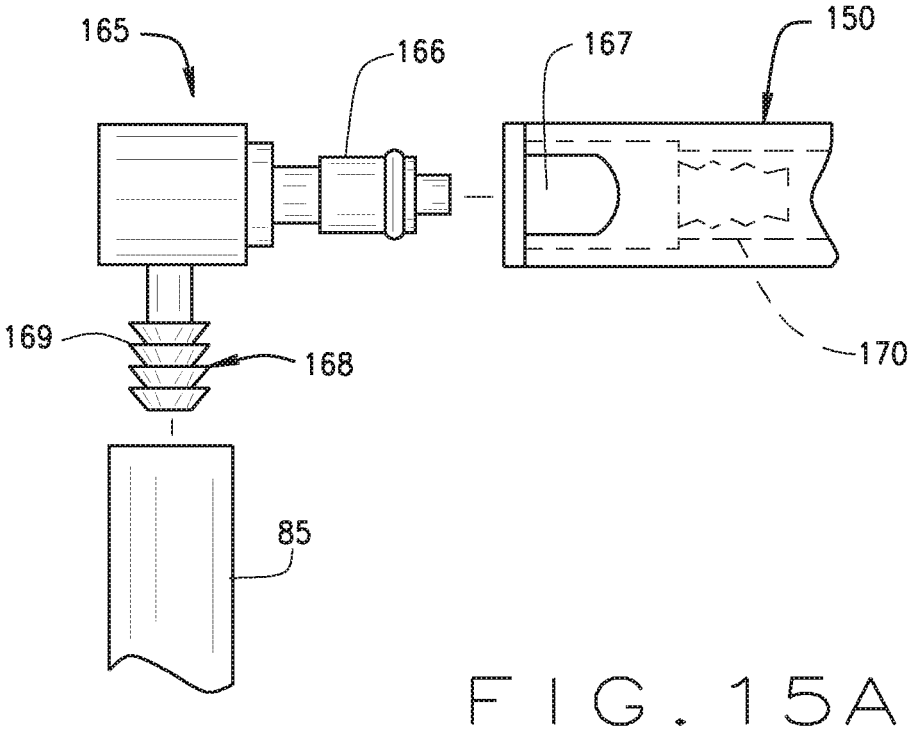
FIG. 15A is an exploded view showing one embodiment of a quick connect/disconnect coupling member used to connect the paint brush apparatus in fluid communication with tubing associated with the carrier member.

As best illustrated in FIGS. 15-18, brush tubing 85 is attached in fluid communication to paint brush apparatus 20 through the use of an L-shaped joint or coupling member 165. L-shaped joint 165 is hollow inside so as to allow paint traveling through brush tubing 85 to be in fluid communication with joint 165 and includes a male connector portion 166 for mating with a corresponding female connector portion 167 associated with paint brush apparatus 20 as best shown in FIG. 15A as well as connector portion 168 for mating with one end portion of brush tube 85 as likewise illustrated in FIG. 15A. Connector portion 168 can include a plurality of barbs or other projections such as barb portions 169 for firmly mating and gripping brush tube 85 when inserted therein and female connector portion 167 can include a release lever 171 for allowing engagement and disengagement of male connector portion 166 to female connector portion 167. Connector portions 166, 167 and 168 are well known in the art. Other connection arrangements are also available and anticipated. Coupling member 165 functions as a quick connect/disconnect coupling member allowing a user to quickly and easily change out paint brushes, if necessary, as previously explained. This allows a user to change brushes, depending upon the application, or paint color, brush size or shape, or for cleaning and/or storage.

L-shaped joint 165 also preferably swivels in a continuous clockwise or counter-clockwise direction so to allow tubing 85, including tubing 25, to swivel with various movements of the paint brush apparatus 20, thereby preventing tubing 25 including brush tubing 85 from getting tangled while working on a painting project.

As best shown in the cross-sectional view of paint brush apparatus 20 in FIG. 18, handle portion 150 and base portion 155 are preferably hollowed out so as to include inner tubing 170 having one end portion thereof releasably engageable with the female connector portion 167 as best illustrated in FIG. 15A. The coupling of brush tubing 85, L-shaped joint 165, and inner tubing 170 allows for paint being pumped from pump 70 to fluidly travel from pump 70 through tubing 25/85, through joint/coupler 165 and then through inner tubing 170.

Paint brush apparatus 20 may further include a two-way valve 175. Two-way valve 175 may be positioned and located inside of the hollow portion of base portion 155 as illustrated in FIG. 18, and preferably includes an intake channel 180 and two output channels 185. A valve control mechanism 190 coupled to valve 175 allows a painter to control flow through two-way valve 175. Valve control mechanism 190 is positioned and located on the exterior of base portion 155 and functions as an on/off valve control for controlling whether paint housed in inner tubing 170 is able to flow downstream toward bristle members 160 in a manner which will be described hereinafter. In one position, control valve 190 prevents paint located in tubing 170 from progressing to exit tubing 195 whereas in a second position, control valve 190 allows paint located in tubing 170 to progress through exit tubing 195 to bristle members 160 as will be explained. For the most part, valve control mechanism 190 functions as an "emergency" shut off valve.

Exit tubing 195 may be positioned and located within base portion 155 of paint brush apparatus 20 as illustrated in FIG. 18 and one end portion of each exit tube 195 is coupled with one of the respective output channels 185 of two-way valve 175 such that when valve control mechanism 190 is positioned to allow flow through two-way valve 175, paint will flow through valve 175 and enter and flow through exit tubing 195. The distal portions 200 of exit tubing 195 are in fluid communication with a bladder member 205. Bladder member 205, which is coupled with and in fluid communication with exit tubing 195, allows paint flowing through exit tubing 195 to be disbursed and distributed to the bristle members 160 for carrying out a painting operation. Control valve 175 may include just a single output channel 185, in which case bladder member 205 must include at least one opening for receiving exit tubing 195. It is also recognized and anticipated that both control valve 175 and bladder member 205 may include any number of complimentary output channels/bladder openings for receiving paint from valve 175 to bladder member 205.

Figure 19:
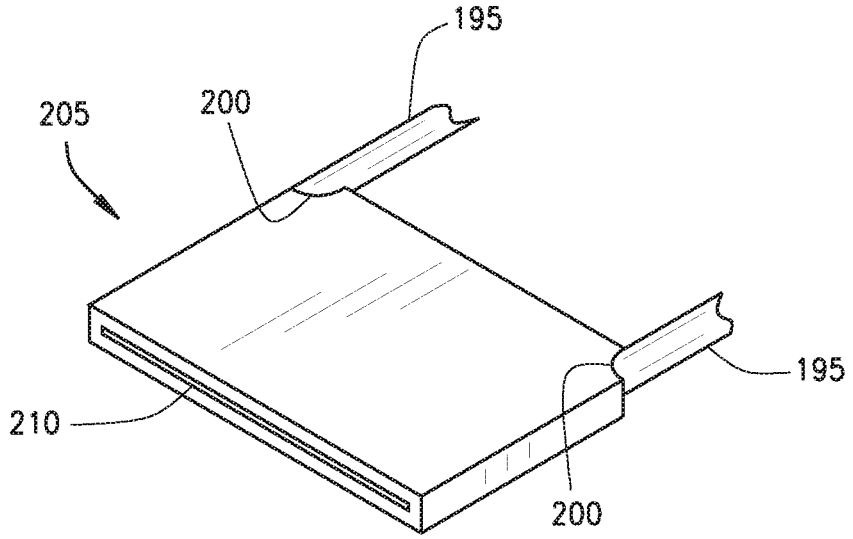
FIG. 19 is a perspective view of one embodiment of a bladder member associated with the paint brush apparatus of FIGS. 15-18.

One embodiment of bladder member 205 is shown in greater detail in FIG. 19 with exit tubing 195 coupled thereto at the respective opposite ends thereof. As shown in FIG. 19, bladder member 205 includes a slit 210 which extends substantially along the full length thereof from which paint or stain may be distributed when pump 70 is activated in a manner described hereinbelow. After paint or stain, or any other substance, is distributed from slit 210, it flows through bristle members 160 allowing a painter 1 to paint in a conventional manner.

Figure 20:
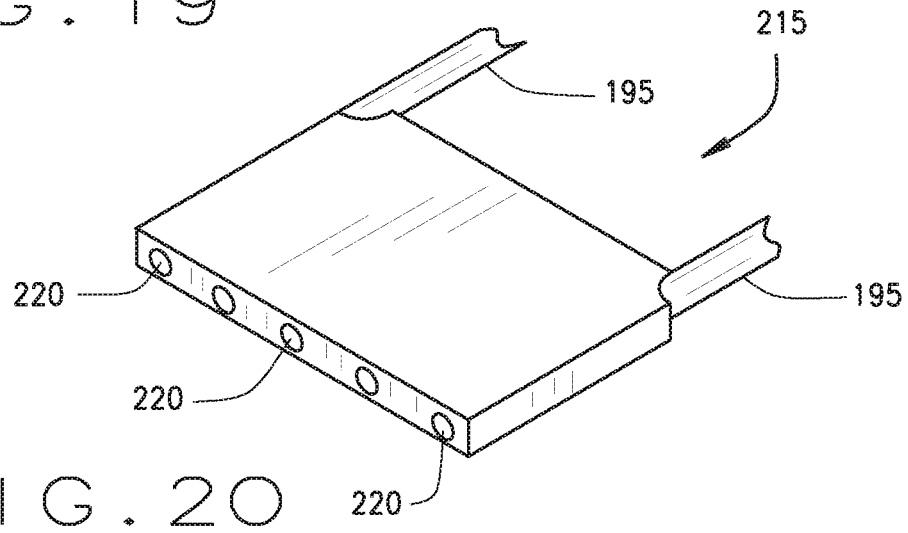
FIG. 20 is a perspective view of an alternative embodiment of a bladder member that can be used with the present paint transfer system.
Figure 21:
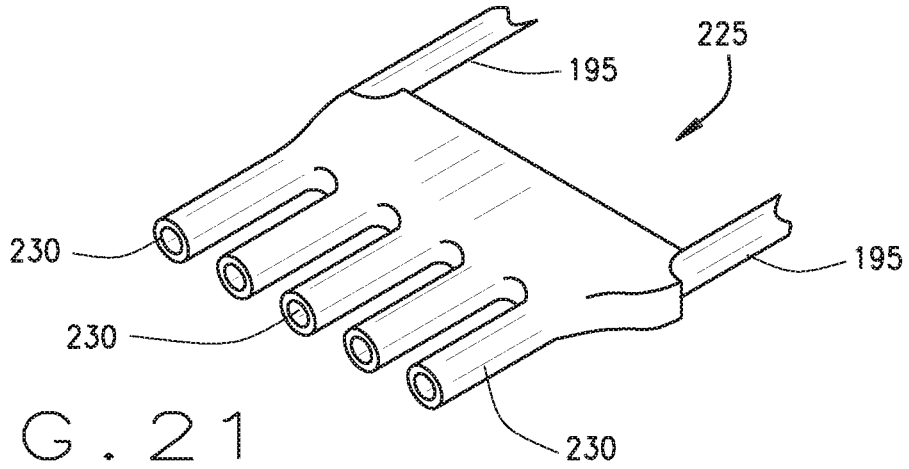
FIG. 21 is a perspective view of yet another alternative embodiment of a bladder member that can be used with the present paint transfer system.

Alternative embodiments to bladder member 205 are illustrated in FIGS. 20 and 21. In FIG. 20, a first alternative bladder member 215 is illustrated that includes a plurality of apertures 220 from which paint or stain may be distributed prior to painting. Similarly, FIG. 21 illustrates a second alternative bladder member 225 which includes a plurality of tubular members 230 from which paint or stain may be distributed when painter 1 is ready to paint a particular surface. In the various embodiments of bladder members 205, 215, 225, it should be noted that any bladder member should be positioned and located toward a center portion of bristle members 160 as shown in FIG. 18. Such positioning of any bladder member will allow paint, stain or any other substance to be evenly distributed within bristle members 160 prior to being applied to a painting surface. It is recognized and anticipated that a wide variety of different bladder configurations may be used to distribute paint to bristle members 160 including just a housing member for guiding the paint, stain or other fluid to the bristle members 160. In addition, it is also recognized and anticipated that the two way valve 175 may comprise any number of output channels 185 and a corresponding number of exit tubing 195 may be connected thereto. It is also recognized that valve 175 may include just a single output channel 185 attached to a single exit tube 195 as previously described.

With the various components that make up the present automatic paint transfer system 5 described above, operation of the present paint transfer system 5 by painter 1 will now be described with respect to painting a particular surface. As indicated above, the present automatic transfer system 5 can be used to apply stain or any other substance that is spreadable by a brush to a particular surface. When painter 1 is prepared to paint a surface, he or she preferably has paint brush apparatus 20 in his or her dominant painting hand, and remote control member 15 in his or her non-dominant hand, as shown in FIG. 1.

When ready to paint, painter 1 depresses the first activation trigger 125 causing an activation signal to be sent via wiring 145 to pump 70 and electronics associated therewith. The activation signal triggers pump 70 to activate its peristaltic motion as described above, which peristaltic pump motion causes paint to be pumped from paint container member 50 to pump 70 via bag tubing 80, and then paint is pumped away from pump 70 toward paint brush apparatus 20 via brush tubing 85. Paint travels via brush tubing 85 upwards through remote control member 15 until reaching paint brush apparatus 20. From there, paint enters paint brush apparatus 20 via L-shaped joint 165 and passes subsequently through inner tubing 170 (not illustrated in FIG. 1), until reaching valve control mechanism 190. Provided valve 190 is in its open position, paint will continue to flow through valve 175, through output channels 185, through exit tubing 195 and subsequently through bladder member 205, 215, or 225.

After exiting one of the bladder members, paint will be distributed to bristle members 165 and a painter can then pain using brush 20 in a manner commonly known and understood in the art. Painter 1 may repeat depressing first activation trigger 125 whenever he or she desires additional paint to be supplied to the brush apparatus 20. Should a painter run out of paint in the middle of a project, he or she may remove cap member 105 and provide more paint to fluid chamber 100. If the type or color of paint required for a job needs to be changed, painter 1 may replace paint container member 50 with another paint container member 50 that contains the appropriate paint mix for the project. When painter 1 has completed a particular project, the present paint transfer system 5 may be flushed out simply by providing water and a cleaning agent as known and understood in the art to paint container member 50 and operating the present system 5 in the manner described above using first activation trigger 125. Such a cleaning method not only clears out paint container member 50 and tubing 25, but it also provides a way to clean bristle members 160 such that paint brush apparatus 20 may be used again for another project. Any conventional method for cleaning the bristle members 160 of brush apparatus 20 may also be used.

Figure 22:
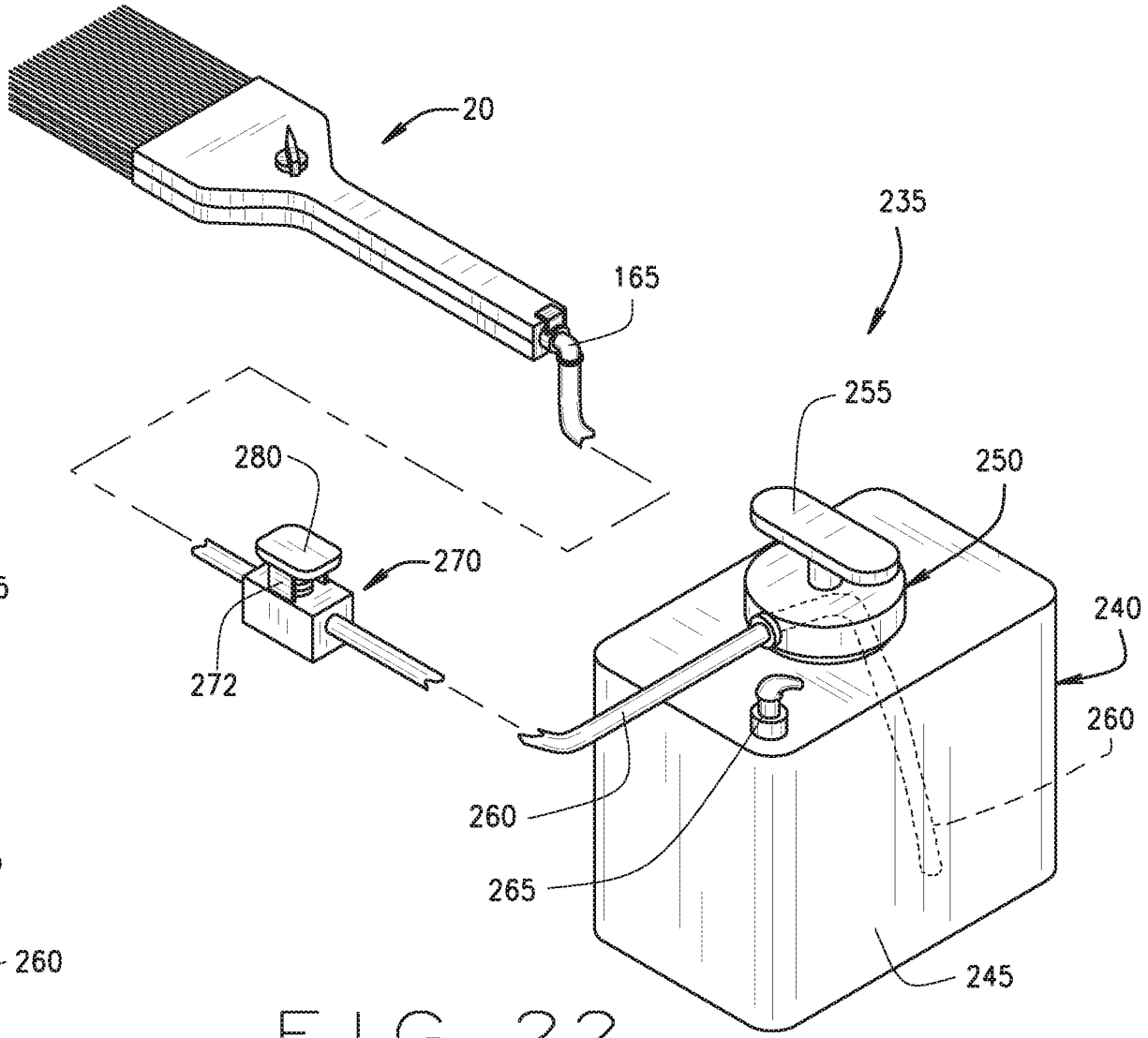
FIG. 22 is an exploded view of one embodiment of a manual paint transfer system constructed according to the teachings of the present invention.

As alternative embodiments to automatic paint transfer system 5 shown and described above in FIGS. 1-21, several manual embodiments of the present invention may be useful in a wide variety of different scenarios, for example, in scenarios where little to no paint is needed for a particular job. FIG. 22 illustrates an exploded view of a first embodiment of a manual painting system 235. In manual painting system 235, paint brush apparatus 20 is identical as disclosed with respect to automatic paint transfer system 5, however the pump source from which paint is provided to brush apparatus 20 is different as will be hereinafter explained.

Manual painting system 235 includes a paint container member 240 having a lower container portion 245 for housing and containing paint and a manual pressure pump 250 for expelling paint from container member 240 to brush apparatus 20 as will be hereinafter explained. In one embodiment, paint container member 240 is disposable, but in alternative embodiments, paint container member 240 may be provided such that lower container portion 245 may be refillable with alternative paints for various projects.

Pressure pump 250 includes a handle member 255 and a piston at its distal end portion (not illustrated) for providing air pressure to lower container portion 245 when handle member 255 is pushed and pulled in a conventional pumping or reciprocating manner. Tubing 260 is coupled to the top of the pressure pump 250 and has one end portion in fluid communication with lower container portion 245 and its other end portion in fluid communication with paint brush apparatus 20. Tubing 260 is similarly attached to L-shaped joint or coupler 165 as previously explained with respect to paint system 5. Paint container member 240 may also include a pressure release valve 265 for use when a project is completed or it is otherwise necessary to release pressure that has accumulated in paint container member 240.

Figure 23:
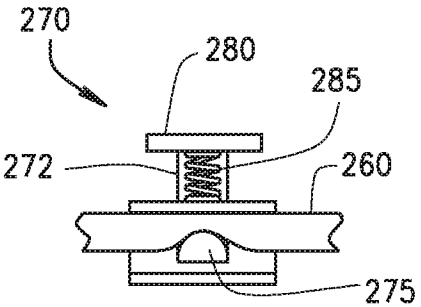
FIG. 23 is a cut-away view of the manual remote control member of the manual paint transfer system of FIG. 22 showing the remote control member in its relaxed or unactivated position.
Figure 24:
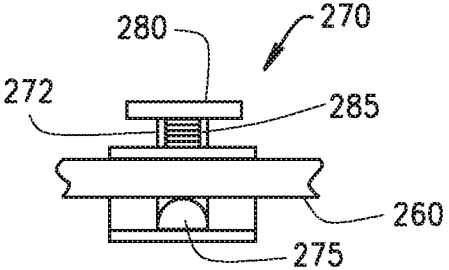
FIG. 24 is a cut-away view similar to FIG. 23 showing the manual remote control member of FIG. 22 in an activated position.

In manual painting system 235, the remote controller 270 used to control paint flow from paint container member 240 to paint brush apparatus 20 is a manual control rather than the automatic remote control member 15 used in paint transfer system 5. Manual painting system 235 preferably includes manual remote control member 270 which is positioned and located around tubing 260 between paint container member 240 and paint brush apparatus 20. In this regard, FIG. 23 illustrates manual remote control member 270 in its rest position, and FIG. 24 illustrates manual remote control member 270 in its engaged position. When manual remote control member 270 is in its rest position, a lip portion 275 positioned and located at a distal end of member 272 is biased upwardly via a spring member 285 such that tubing 260 is pinched, thereby preventing paint from flowing through tubing 260 toward paint brush apparatus 20. Member 272 is likewise connected to button or depression member 280 such that when button member 280 is depressed as shown in FIG. 24, spring member 285 is compressed and biases lip portion 275 downwardly and away from tubing 260 thereby allowing paint to flow through tubing 260 and toward paint brush apparatus 20 so long as button member 280 stays depressed. Upon releasing button member 280, manual remote control member 270 returns to its rest state as shown and illustrated in FIG. 23 thereby stopping paint flow to brush apparatus 20. When a painter is prepared to distribute paint to a particular surface, he or she depresses button member 280 again as needed. Paint will flow through brush apparatus 20 and through bladder member 205, 215 or 225 to bristle members 160 as is previously explained with respect to automatic system 5. When air pressure is depleted within container member 240, the painter will again use pressure pump 250 to build up pressure within container 240 for further pumping paint to brush apparatus 20 via manual controller 270.

In operation, it is recognized that a painter can also place valve control mechanism 190 associated with paint brush apparatus 20 in its off or closed position thereby preventing paint from flowing past control valve 175 to bristle members 160. With control valve 190 closed, and remote controller 270 in its rest position, a painter can build up air pressure within painter container 240 by reciprocal pumping of pressure pump 250 before starting a painting task. Once pumping of the pressure pump 250 is complete, the painter can open control valve 190 and then use the manual remote controller 270 to start the flow of paint from the paint container 240 to paint brush apparatus 20. Use of control valve 190 is optional and provides an extra layer of protection to prevent paint from flowing to the bristle members 160 of paint brush 20 during the pumping operation.

Figure 25:
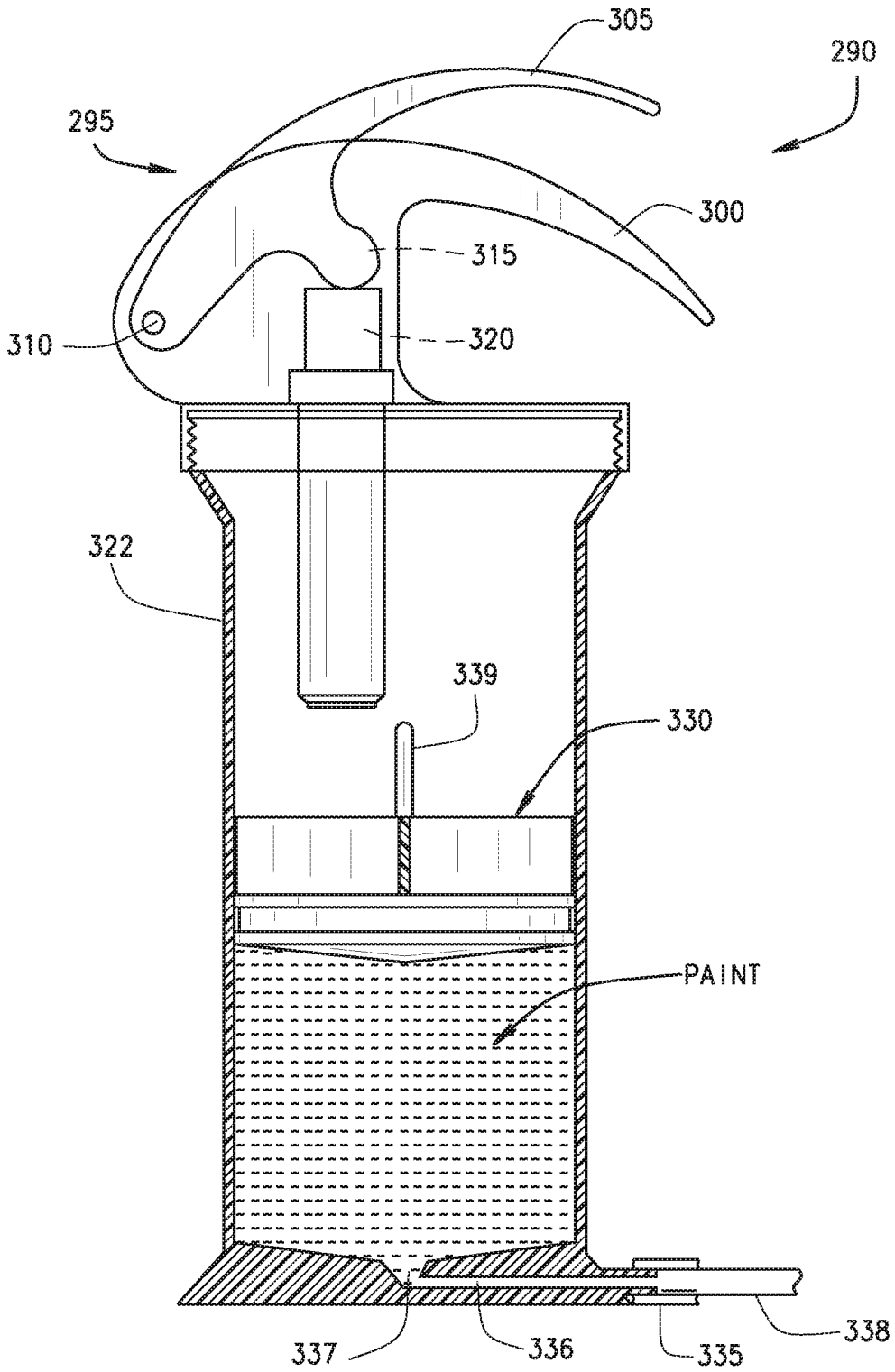
FIG. 25 is a partial cross-sectional view of another embodiment of a manual paint transfer system constructed according to the teachings of the present invention.

FIG. 25 illustrates yet another alternative embodiment 290 of a manual painting system 290 which includes a handle mechanism 295 having a fixed member 300 and a rotatable member 305. Fixed member 300 and rotatable member 305 are engaged by way of a pin member 310 that allows rotatable member 305 to move relative to fixed member 300. Rotatable member 305 also preferably includes a knob or flange portion 315 extending therefrom as shown in FIG. 25, knob portion 315 being positioned and located such that it is in physical contact with a pneumatic piston 320.

The handle mechanism 295 is attachable to a paint container member 322 in a conventional manner, such as via a corresponding thread engagement as shown and illustrated. Paint container member 322 holds paint or stain or any other brush spreadable substance at any level within container 322 as illustrated. When a surface is ready to be painted, paint container member 322 is filled with paint by removing the handle mechanism 295 and the pressure stopper 330 which sits within paint container 322 and on top of the paint or stain stored therewithin. The pressure stopper 330 is preferably sized such that it tightly fits within container 322 above the stored paint or stain as illustrated in FIG. 25 but yet can be easily removed when paint is added to the paint container 322. Painting system 290 also includes an outlet member 335 at the bottom portion of container 322, the outlet member 335 being coupled in fluid communication with the interior portion of paint container 322 at one end portion thereof via passageway or channel 336 and an opening 337 in the bottom portion of the paint container 322. Tubing 338 similar to tubing 25 and 260 associated with paint systems 5 and 235 is insertable within outlet 335 and channel 336 and has one end portion in fluid communication with opening 337 of paint container 322. The opposite end portion of tubing 338 is attached to paint brush apparatus 20 in a manner as previously described above.

In operation, when a painter is prepared to distribute paint from manual painting system 290 to paint brush apparatus 20, he or she will use one hand to grip handle mechanism 295 and will hold paint brush apparatus 20 with the other hand. By squeezing rotatable member 305 relative to fixed member 300 with one hand, knob or flange portion 315 of rotatable member 305 will be pushed downwardly so as to depress pneumatic piston 320. When pneumatic piston 320 is depressed, air is released or pumped from pneumatic piston 320 toward pressure stopper 330. Pressure stopper 330 has sufficient surface area such that air ejected from pneumatic piston 320 will act on pressure stopper 330, thus pushing pressure stopper 330 downwardly such that it acts on the paint or stain stored therebelow and forces the paint or stain downwardly thereby forcing paint or stain from paint container 322 through opening 337 and into tubing 338 toward paint brush apparatus 20 (not illustrated) via outlet member 335. Paint brush apparatus 20 functions and operates as described above.

In order to supply more paint from paint container 322 to paint brush apparatus 20, a painter can repeatedly depress rotatable member 305 relative to fixed member 300. This reciprocating action pumps more air into container 322 above the pressure stopper 330 and continues to force paint from paint container 322. The amount of air pressure within container 322 will dictate the flow of paint to paint brush apparatus 20. This allows a painter to control the paint flow to brush 20 based upon the reciprocating motion of handle member 305. Pressure stopper 330 also preferably includes a return pull member 339 which may be used to manually pull and remove pressure stopper 330 when the paint container 322 is refilled and it can be used to adjust the stopper 330 closer to pneumatic piston 320 or closer to the paint stored therein after use. Paint container 322 may be a disposable paint container, or in an alternative embodiment, paint container 322 may be a cleanable and refillable paint container as commonly known and understood in the art.

It is also recognized that a painter can place valve control mechanism 190 on paint brush apparatus 20 in its off position so that paint flow to the bristle members 160 is stopped, and then the painter can build up any amount of air pressure desired within container 322 above pressure stopper 330 before starting a painting operation. Once the reciprocal pumping action of handle member 305 is stopped, a painter can open control valve 190 and allow the air pressure stored in container 322 to provide paint flow to bristle members 160 for applying paint to a surface. This procedure can be repeated any number of times until a particular paint project is completed.

Figure 26:
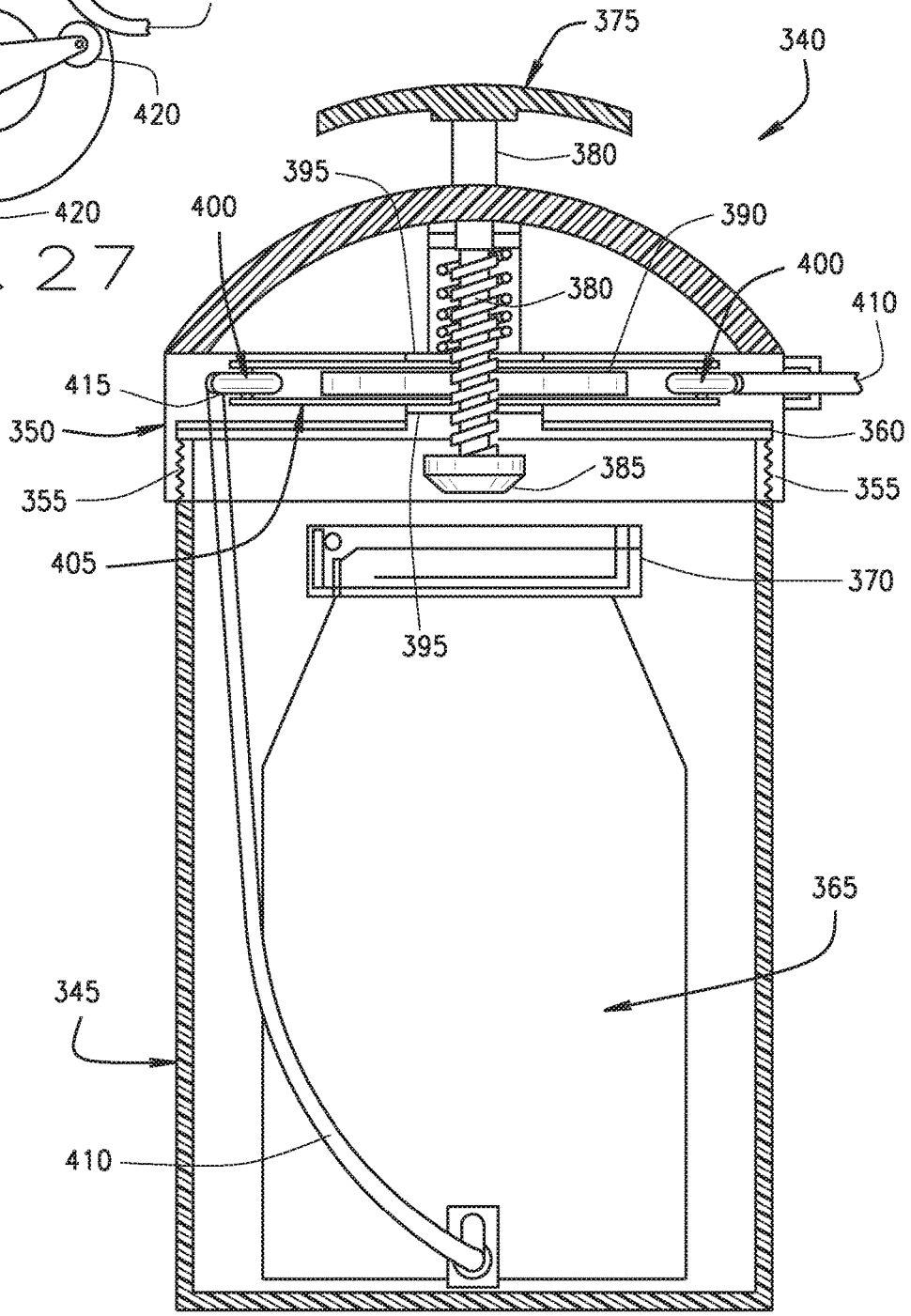
FIG. 26 is a cross-sectional view of yet another embodiment of a manual paint transfer system constructed according to the teachings of the present invention.

FIG. 26 illustrates still another alternative embodiment 340 to manual painting systems 235 and 290. In this embodiment, manual painting system 340 includes a base member or container 345 and a top member 350 releasably engageable with base member 345 by way of cooperatively engageable threaded portions 355 that allow top member 350 to act as a "screw-on lid" as commonly known and understood in the art. A seal 360 may further be provided to help base member 345 and top member 350 remain sealably engaged. A paint container member or bag 365 is provided that is removably insertable within base member 345, paint bag 365 being designed and configured to hold paint that will be applied to a painting surface. Paint bag 365 may include a snap member 370 that allows paint bag 365 to be sufficiently sealed to prevent paint from leaking therefrom and also to make the bag 365 reusable by removing snap member 370 and refilling paint bag 365 with paint.

Top member 350 includes a handle member 375 having a shaft member 380 and a stopper member 385. Shaft member 380 is selectively engageable with a rotor mechanism 390 via a threaded engagement such that when handle member 375 is pumped downwardly, threads associated with shaft member 380 engage complementary threads associated with rotor mechanism 390. As understood in the art, such motion causes rotor mechanism to rotate in the direction of the threads, in this case, clockwise, though in alternative embodiments counterclockwise rotation is also within the scope of the present invention. Friction spacer sleeves 395 are positioned and located above and below rotor mechanism 390 to reduce the friction generated during the pump-down action of handle member 375 and rotation of rotor mechanism 390.

Figure 27:
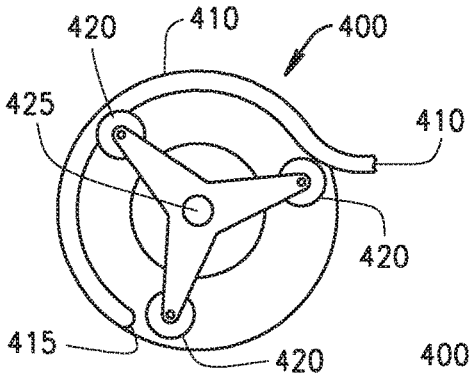
FIG. 27 is a top plan view of a peristaltic wheel associated with the manual paint transfer system of FIG. 26.

Wheel roller members 400 are further associated with rotor mechanism 390. More specifically, wheel roller members 400 are fixably attached to rotor mechanism 390 via a wheel housing 405. In the illustrated embodiment, manual painting system 340 and rotor mechanism 390 include two wheel roller members 400, though in alternative embodiments, greater or fewer wheel roller members may be provided. An example wheel roller member 400 is illustrated in greater detail in FIG. 27. Each wheel roller member 400 includes a plurality of cams 420 that are fixed to a rotatable pivot member 425. As shown in FIG. 26, painting system 340 also includes exit tubing 410 coupled in fluid communication with the bottom portion of paint bag 365, the exit tubing 410 being positioned and located so as to circumscribe at least a portion of each wheel roller member 400 as illustrated in FIG. 27. As shown in FIG. 26, exit tubing 410 enters the housings associated with wheel members 400 at an opening 415. As best illustrated in FIG. 27, exit tubing 410 is fed approximately halfway around the circumference of wheel roller member 400.

As rotor mechanism 390 is turned, similarly wheel roller members 400 rotate in a clockwise direction. As wheel roller members 400 rotate in a clockwise direction, cam members 420 likewise rotate and travel in a clockwise direction. As a result of this motion, at least one cam 420 is periodically in direct contact with exit tubing 410 in the manner shown in FIG. 27 during each rotation of wheel roller member 400. Cam members 420 create a vacuum in the tubing 410 by squeezing tubing 410 as wheel roller member 400 is moved clockwise, thus creating pressure in that direction when rotated and drawing paint from paint bag 365. A broken portion of tubing 410 is illustrated in FIGS. 26 and 27. The tubing 410 is in fluid communication with paint brush apparatus 20 as shown and described in detail above. Again, paint brush apparatus 20 functions and operates as previously described.

It should be noted that gear teeth associated with shaft member 380 are angled such that when handle member 375 is returned to its original position after being depressed, the handle member 375 is returned to its position without reversing rotation of rotor mechanism 390. This mechanism may be structured in a number of ways, however, in the preferred embodiment, a spring 382 is used to disengage a gear associated with shaft member 380 when handle member 375 is returned to its original position.

In operation, reciprocal movement of handle member 375 by a painter causes the cam members 420 to intermittently squeeze the tubing 410 at each wheel roller member 400 thereby intermittently creating a vacuum and drawing paint from paint bag or container 365. Continuous pumping of handle member 372 will provide a continuous flow of paint to paint brush apparatus 20. Once the pumping action ceases, paint flow from paint container 365 will likewise cease. A painter can control the application of paint to the brush 20 through the use of valve control mechanism 190 on the paint brush apparatus 20. Sufficient pumping action can again advance paint throughout the length of tubing 410 with the control valve 190 in its off position. Once pumping action is stopped, a painter can open control valve 190 and allow the paint stored within tubing 410 to flow to the bristle members 160 of brush 20 for a painting application. A painter can also continue to pump handle member 37 with one hand and paint with brush 20 in the other hand thereby providing a continuous flow of paint to paint brush 20.

Figure 28:
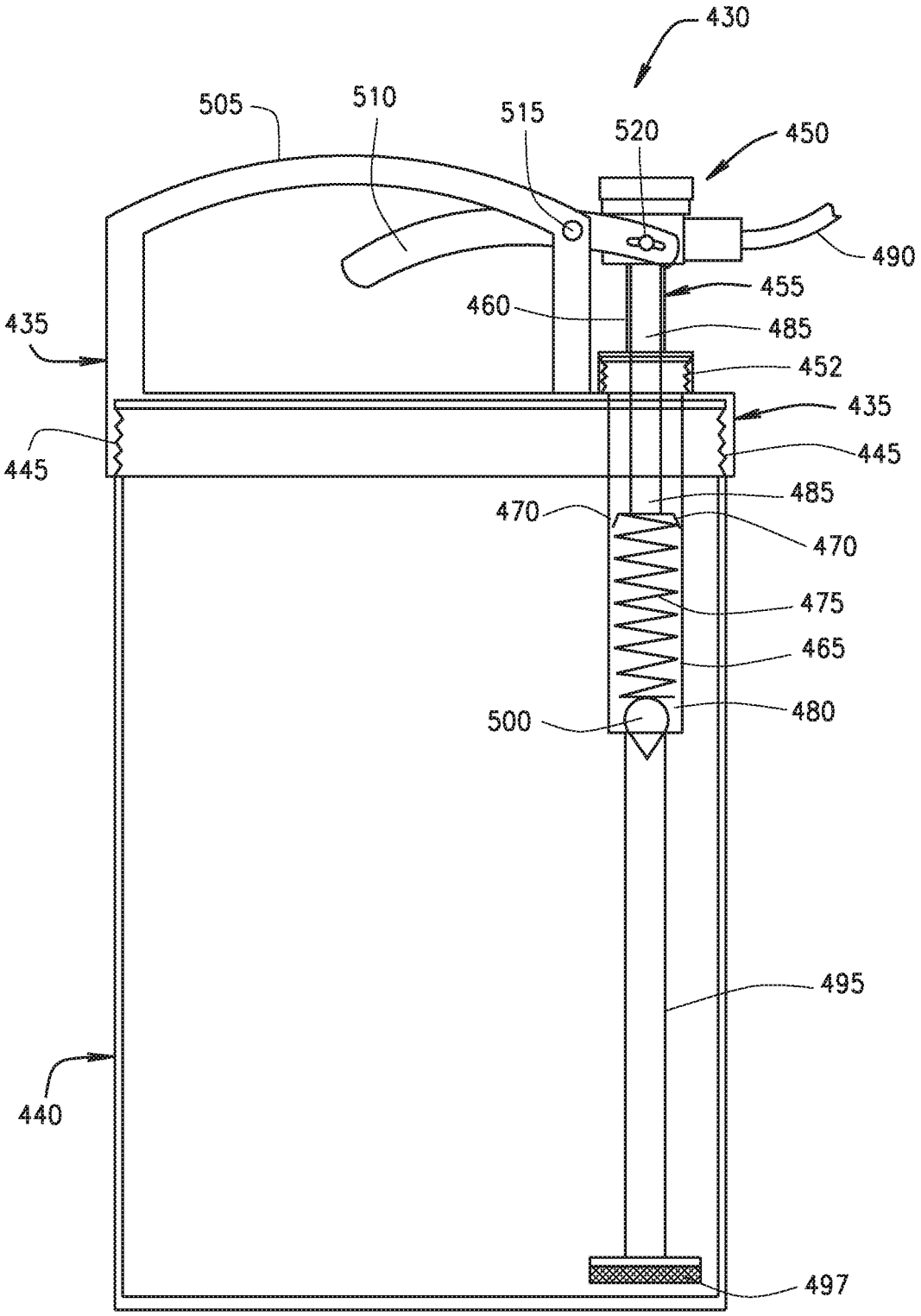
FIG. 28 is a partial cross-sectional view of still another alternative embodiment of a manual paint transfer system constructed according to the teachings of the present invention showing the trigger mechanism and its associated components in an activated position.
Figure 29:
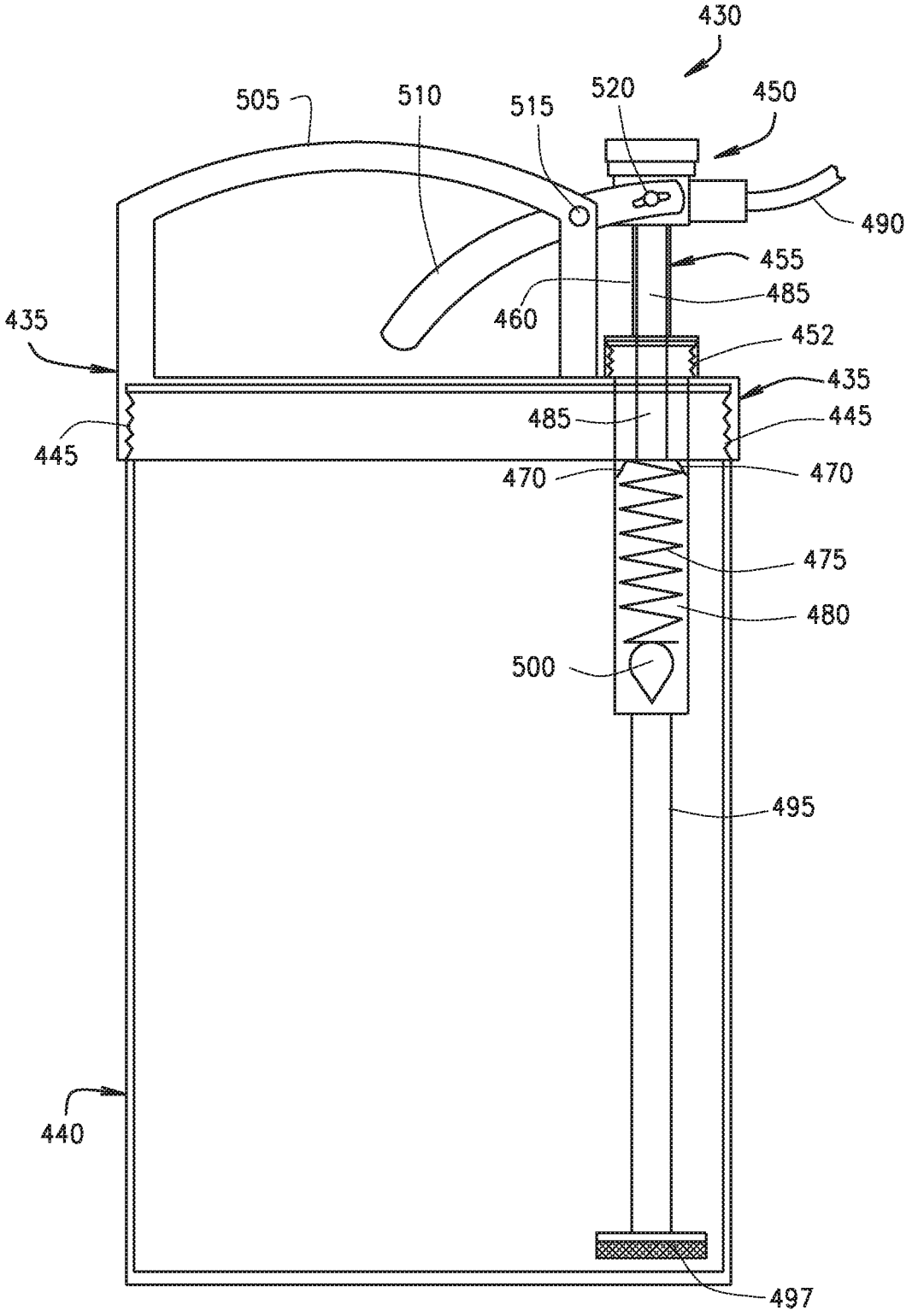
FIG. 29 is a partial cross-sectional view similar to FIG. 28 showing the trigger mechanism and its associated components in a relaxed or inactivated position.

FIGS. 28 and 29 illustrates still a further alternative embodiment 430 to manual paint systems 235, 290, 340. Manual painting system 430 includes a lid member 435 and a paint container member 440, the lid member 435 being attachable to the container member 440 by any suitable means such as, for example, by the use of a complementary threaded mechanism 445. A pump assembly 450 is further associated with manual painting system 430 and is releasably attachable to lid member 435 via a second threaded mechanism 452. Pump assembly 450 includes a vertical shaft 455 having an upper shaft portion 460 positioned and located above lid member 435 and a lower shaft portion 465 positioned and located below lid member 435. Lower shaft portion 465 has a circumference or diameter greater than that of upper shaft portion 460. Beveled step portions 470 between upper shaft portion 460 and lower shaft portion 465 provide the circumference or diameter step change between shaft portions 460 and 465 within central shaft 455. Because of the circumferential differences between shaft portions 460 and 465, a spring member 475 having a circumference or diameter greater than that of upper shaft portion 460 may be housed and secured around lower shaft portion 465 adjacent to and in contact with beveled step portions 470 as illustrated in FIGS. 28 and 29.

Pump assembly 450 also includes an ejection chamber 480 which surrounds the lower vertical shaft 465 below lid member 435 as well as spring member 475. A paint channel 485 located inside of vertical shaft 455 is coupled in fluid communication at one end with exit tubing 490 and with an intake tubing 495 at its other end. Exit tubing 490 is connected in fluid communication with paint brush apparatus 20 (now shown) which functions and operates as previously described. An intake filter 497 located near the terminal end portion of intake tubing 495 is used to filter and remove particulates from the paint pumped from the interior of paint container member 440 into intake tubing 495 during the activation process. A float member 500 is contained within ejection chamber 480 as illustrated in FIGS. 28 and 29 and is biased against spring member 475 as will be hereinafter explained.

Lid member 435 likewise includes a handle portion 505 that may be held with one hand by a painter and a trigger mechanism 510 that is movable relative to handle portion 505 by way of pin member 515. Trigger mechanism 510 is also attached to vertical shaft 455 by way of a second pin member 520, and when moved relative to handle portion 505, allows handle portion 505 to be in one of two positions as explained below.

In a first activated position, as shown in FIG. 28, trigger mechanism 510 has been pulled upwardly, and vertical shaft 455 has been pushed downwardly. As a result, beveled step portions 470 are pushed downwardly and spring member 475 is also pushed downwardly and compressed. Because spring member 475 is pushed downwardly, float member 500 is also pushed downwardly into contact with the opening of intake tubing 495 as it mates with ejection chamber 480 thereby sealing the opening of intake tubing 495 such that no paint may enter ejection chamber 480 via intake tubing 495. In this first activated position as illustrated in FIG. 28, float member 500 blocks intake tubing 495. As float member 500 engages intake tubing 495 at the bottom portion of ejection chamber 480, the volume of paint already in ejection chamber 480 is reduced as pressure within ejection chamber 480 forces paint previously drawn into ejection chamber 480 (in a manner described below) through vertical shaft 455 and subsequently through paint channel 485, exit tubing 490 and ultimately to paint brush apparatus 20.

In a second relaxed or unactivated position illustrated in FIG. 29, trigger mechanism 510 is released and vertical shaft 455 is no longer depressed but instead is pulled upwardly relative to its position shown in FIG. 28. As a result, lower shaft portion 465 of vertical shaft 455, and its beveled step portions 470 are also pulled upwardly relative to their positions shown in FIG. 28 thereby relaxing spring member 485 and relaxing pressure on float member 500. In this second relaxed position, float member 500 unseals itself from intake tubing 495 at the bottom portion of ejection chamber 480, and a gap (not illustrated) forms between ejection chamber 480 and intake tubing 495. This gap allows paint to freely flow from paint container member 440 into ejection chamber 480, and paint within ejection chamber 480 is primed for its next ejection which is triggered by activating trigger mechanism 510 in the manner described herein above.

In operation, a painter will open control valve 190 associated with paint brush apparatus 20 and will grip handle portion 505 and trigger mechanism 510 with one hand. Reciprocal movement of trigger mechanism 510 will pump paint from paint container 440 into ejection chamber 480 and through shaft 455 and tubing 490 to paint brush apparatus 20. A painter will then paint with paint brush 20 in one hand and continue to reciprocate trigger mechanism 510 during the painting operation with the other hand.

Figure 30:
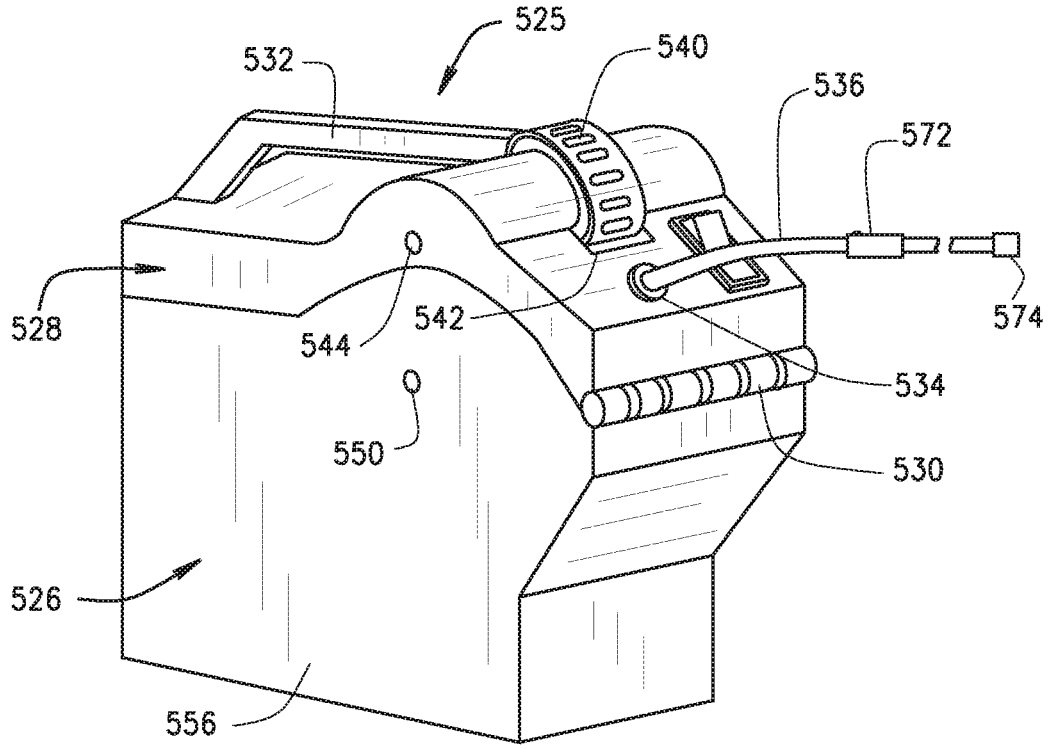
FIG. 30 is a perspective view of still another alternative embodiment of a manual paint transfer system constructed according to the teachings of the present invention.
Figure 32:
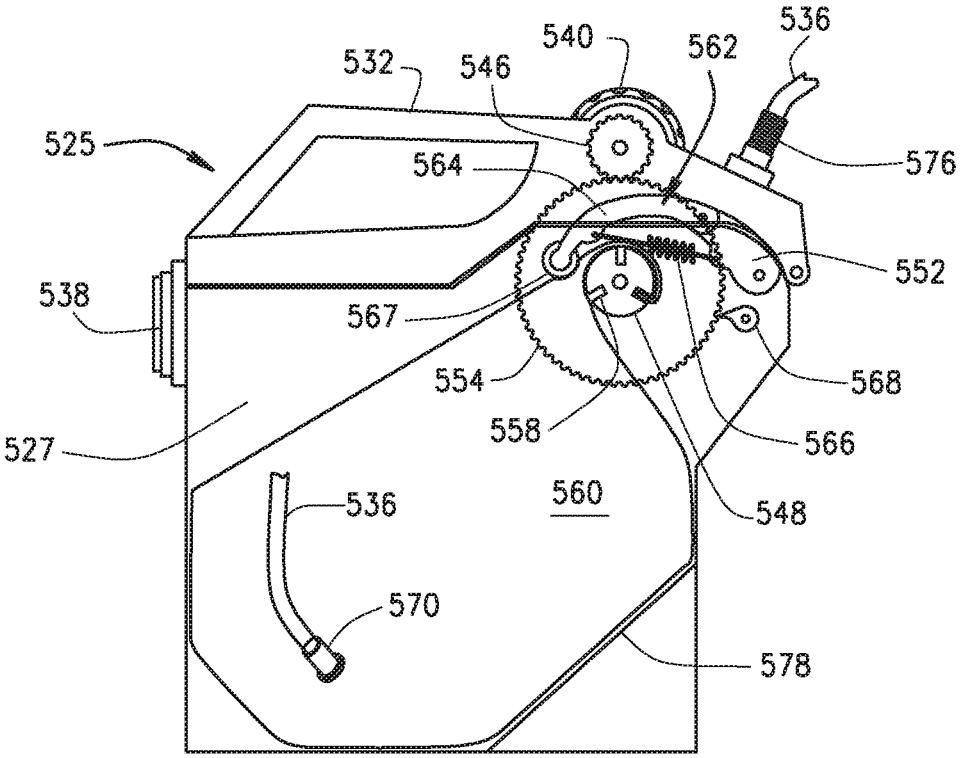
FIG. 32 is a side elevational view of the manual paint transfer system of FIG. 30 with the side portion of the housing member and lid member removed so as to see the internal structure associated therewith.
Figure 31:
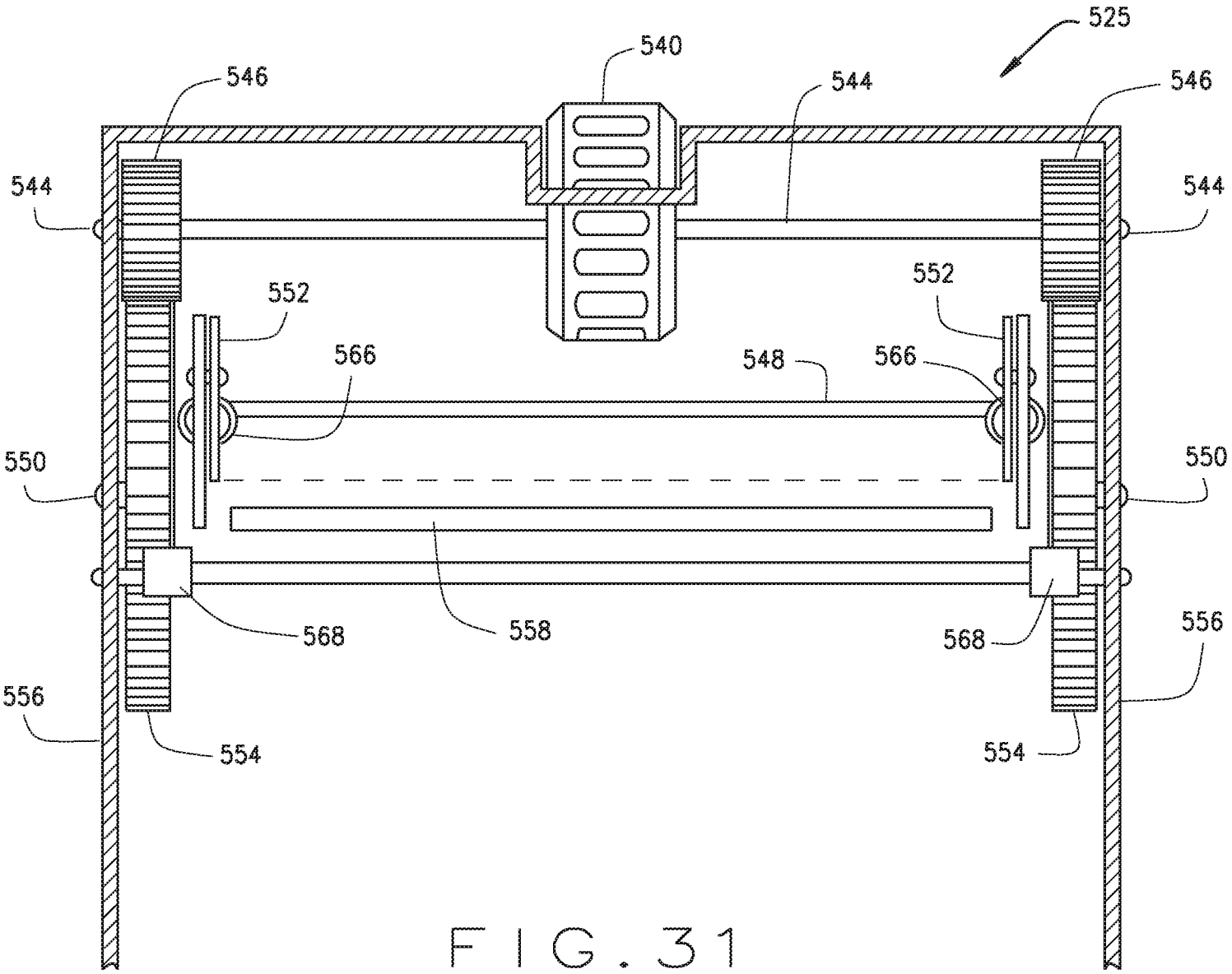
FIG. 31 is a partial front elevational cross-sectional view of the manual paint transfer system of FIG. 30.

FIGS. 30-32 illustrate still another further alternative manual paint system 525 which includes a base member or housing member 526 having an interior space 527 associated therewith as best illustrated in FIG. 32 and a lid member 528 hingedly attached to the housing member 526 through the use of a conventional hinge mechanism 530. The lid member 528 pivotally rotates about hinge member 530 between a fully closed position as illustrated in FIG. 30 and a fully open position (not shown) wherein the interior space 527 of housing member 526 can be accessed as will be hereinafter further explained. Lid member 528 includes a handle member 532 for easily carrying the manual paint system 525 from one location to another as well as an opening 534 for allowing bag tube 536 associated with paint bag member 560 from exiting unit 525 enroute to paint brush apparatus 20 as will be hereinafter further explained. A conventional lid latch mechanism 538 as best illustrated in FIG. 32 allows the lid member 528 to be securely latched and locked to the housing member 526 in a conventional manner. Any conventional lid latch mechanism 538 can be utilized to accomplish this task.

Manual paint system 525 utilizes a gear mechanism in conjunction with a specifically designed paint bag 560 to manually roll-up the paint bag onto a roller member thereby allowing the paint or stain in the bag to be squeezed or forced to the bottom of the paint bag during the roll-up process. The squeezing or forcing action pumps paint or stain to the paint brush apparatus 20. More particularly, the present gear mechanism includes an exterior rotatable member 520 which projects through an opening 542 associated with lid member 528 such that a user will have access to the rotatable member 540 during use and can rotate the member 540 using the user's thumb. Rotatable member 540 is attached to gear pin member 544 as best illustrated in FIG. 31, gear pin member 544 extending the full width of lid member 528 as again best illustrated in FIG. 31. The pair of gear members 546 are positioned and located at the respective opposite end portions of gear pin member 544 and are rotatable at the same time roller member 540 is rotated. Rotatable member 540 is positioned and located such that it can be easily rotated by the thumb of a user holding the handle member 532 of paint system 525. Roller member 540, gear pin member 544 and gear members 546 are all positioned and located within lid member 528 as best illustrated in FIGS. 30 and 32.

A bag roller member 548 is positioned and located on gear pin member 550 as best illustrated in FIG. 31, gear pin member 550 extending the full width of the housing member 526 and being mounted within housing member 526 as illustrated. A pair of larger gear members 554 are positioned and located between the opposite end portions of bag roller member 548 and opposed sidewall portions 556 of housing member 526 as best illustrated in FIG. 31, gear members 554 being rotatable with gear pin member 550 and being positioned in engagement with gear members 546 such that when gear members 546 are rotated, such gear members will engage gear members 554 and likewise rotate gear members 554 as well as gear pin member 550 and the bag roller member 548 as will be hereinafter further explained.

Bag roller member 548 includes at least one bag starter slot 558 (FIGS. 31 and 32) for inserting one end portion of a paint bag 560 (FIG. 32) into slot 558 for engaging the paint bag with the bag roller member 548. Once so engaged, bag roller member 548 can be rotated such that the paint bag 560 (FIG. 32) can be at least partially rolled-up onto roller member 548 as illustrated in FIG. 32. The collapsed, rolled-up portion of paint bag 560 is held in place on bag roller member 548 through the use of a spring-loaded pressure roller mechanism 562 as best illustrated in FIG. 32. Pressure roller mechanism 562 includes a pair of bracket members 552 and a pivotally rotatable arm member 564 which is biased towards bag roller member 548 through the use of a pair of spring members 566. The terminal end portion of arm member 564 includes a roller member 567 which is held in engagement with bag roller member 548 through biasing springs 566. As bag member 560 is rotated onto bag roller member 548 as will be hereinafter further explained, the force exerted by arm member 564 and roller member 566 on bag roller member 548 will hold the collapsed, rolled-up portion of bag member 560 in place on roller member 548. In this regard, a pair of ratchet gears 568 (FIGS. 31 and 32) are positioned and located with respect to gear members 554 such that once rotation of bag roller member 548 ceases, ratchet gear members 568 will engage gear members 554 and prevent such gear members from reverse rotation thereby unwinding bag member 560 from bag roller member 548. The ratchet gears 568 hold the roller member 548 at a fixed location once the roller member 548 stops rotating.

Bag member 560 is specially made to hold paint, stain or any other fluid/substance spreadable via a brush and includes an opening at one end portion thereof for filling the bag 560 with paint or stain, such opening being closable via any suitable air tight closure mechanism. The opposite end portion of bag member 560 includes exit or outlet coupling member 570 which is in fluid communication with the bag tubing 536. Bag tubing 536 is long enough so as to be fed through lid opening 534 (FIG. 30) and, like bag member 50, includes a stop member or shut-off valve 572, which can be similar to shut-off valve 83. Bag member 560 also includes coupling member 574 at its terminal end portion for engaging the opposite end portion of brush tubing 85 for connection to paint brush apparatus 20 as previously explained. It is also recognized and anticipated that stop member 572 as well as coupling member 574 could be located along bag tubing 536 located inside the housing member 526 and that cooperative engagement between the terminal end portion of bag tube 536 and one end portion of brush tube 85 could occur inside housing member 526. In this regard, brush tubing 85 would be passed through opening 534 associated with lid member 528 and that end portion of brush tube 85 would connect to bag tube 536. Other connection mechanisms and configurations are likewise envisioned and anticipated. A tube stabilizer member 576 in the form of a wire member could likewise be utilized adjacent exit opening 534 so as to hold the bag tube 536 or brush tube 85 in a stable orientation as it exits lid member 528.

In operation, a painter would hold manual paint system 525 via handle member 532 in one hand and would hold the paint brush apparatus 20 in the painter's dominant painting hand. With the hand holding handle member 532, a painter would use his or her thumb to rotate roller member 540 so as to begin the roll-up action of bag member 560. As roller member 540 is rotated in one direction, gear members 546 are likewise rotated in the same direction and engage gear members 554. Rotation of gear members 544 in turn rotates gear pin member 550 and bag roller member 548 such that bag 560 begins to roll-up onto roller member 548. As bag member 560 is rolled onto bag roller member 548, paint, stain or any other substance contained within bag member 560 will be forced to the bottom of bag member 560 and the pressure build up within bag 560 due to collapsing of the bag onto roller member 548 will force paint, stain or any other fluid/substance within bag 560 out through coupling member 560 and bag tube 536 enroute to the paint brush apparatus 20. Continuous rotation of rotating member 540 and the speed of such rotation will dictate the amount of pressure built up within bag member 560 and the flow rate of the paint, stain or other fluid/substance held therewithin to paint brush apparatus 20. In this regard, the housing member 526 includes an angularly oriented or inclined floor support member 578 as best illustrated in FIG. 32 for supporting and properly positioning bag member 560 within housing member 526 for facilitating the flow of paint, stain or other fluid/substance through outlet coupling member 570 enroute to the paint brush apparatus 20.

As previously explained, it is also recognized that a painter can place valve control mechanism 190 on paint brush apparatus 20 in its off position so that paint flow to the bristle members 160 is stopped. The painter can then build up any amount of air pressure desired within paint bag 560 by continuously rotating rotatable member 540 as previously explained. Once rotation of rotatable member 540 is stopped, a painter can open control valve 190 and allow the air pressure built up within paint bag 560 due to the roll-up action of bag 560 onto roller member 548 to provide paint flow to bristle members 160 for applying paint to a surface. Use of control valve 190 is again optional.

In order to supply more paint from paint bag 560 to paint brush apparatus 20, a painter can repeatedly rotate rotatable member 540 so as to continue to roll-up bag 560 onto roller member 548 thereby forcing paint to the bottom of bag 560 and through bag tubing 536 to paint brush apparatus 20. The amount of rotation of rotatable member 540 as well as the speed of rotation of such member will dictate the flow of paint to paint brush apparatus 20. This allows a painter to again control the paint flow to brush 20 based upon the amount of rotation and speed of rotation of rotatable member 540. Once bag member 560 is completely depleted of paint, stain or any other fluid/substance held therewithin, lid member 528 can be opened and arm member 564 can be lifted such that bag member 560 can be unwound from bag roller member 548 and disengaged therefrom. A new paint bag can then be inserted into any one of the paint starter slots 558 and the process can be repeated any number of times until a particular paint project is completed.

A number of different paint systems, both automatic and manual, have been described hereinabove. Alternative systems are further envisioned herein so long as they are able to store and transfer paint to a paint brush using a pressure or pump mechanism to provide paint directly to a paint brush apparatus.

It is also recognized and anticipated that a manual remote control member similar to the manual remote control member 270 illustrated in FIG. 22 can likewise be used with all of the manual painting systems 290, 340, 430 and 525 illustrated in FIGS. 25-32 for controlling the flow of paint from the various paint container members to paint brush apparatus 20. In this regard, the manual remote controller such as remote controller 270 would be attached to the flexible tubing leading from the paint container member to paint brush apparatus 20 at an intermediate location therealong as previously explained with respect to the manual paint transfer system 235 illustrated in FIGS. 22-24. The remote control member can be positioned at a convenient location along the length of the brush tubing for a user based upon the particular task at hand and the amount of slack in the brush tubing preferred by the user.

Figure 33:
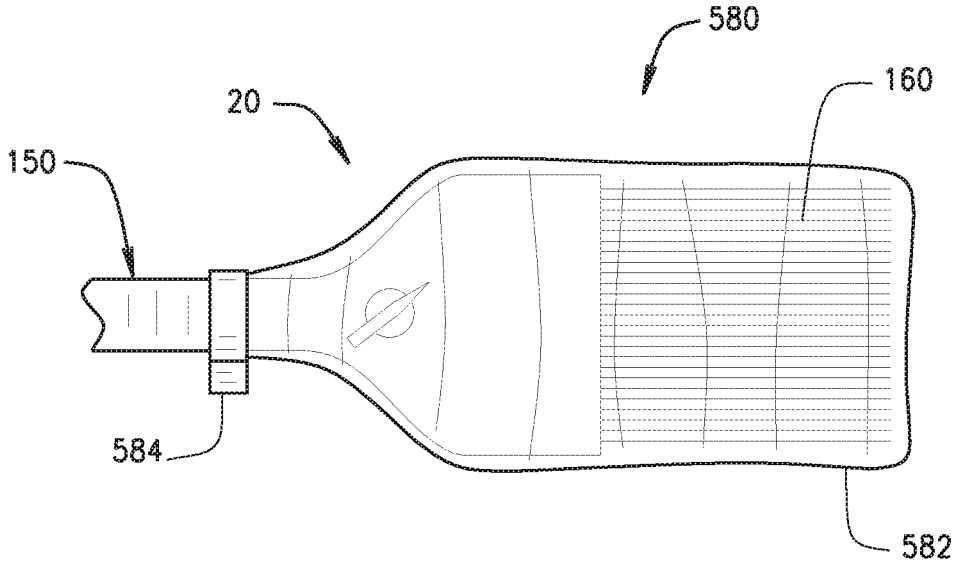
FIG. 33 is a partial top plan form view of one embodiment of a paint brush protector member positioned in operative use on the bristle members of a paint brush apparatus.

FIG. 33 illustrates still another aspect of the present invention. More particularly, one embodiment of a paint brush protector member 580 is illustrated in operative use over the bristle members 160 associated with paint brush apparatus 20 for storing paint brush apparatus 20 after use. Paint brush protector member 580 includes an airtight bag member 582 that is sized and shaped to slip over bristle members 160 and a portion of paint brush apparatus 20 as illustrated in FIG. 33 and further includes an opening with a closure member 584 for tightly sealing the bag 582 around bristle members 160. The present paint brush protector member 580 extends the life of the paint brush when not in use by retaining moisture within the bag member 582 thereby preventing evaporation or brush dry out and further eliminating exposure of the bristle members 160 to outside contaminants such as air, debris, lint, hair, bugs and dirt during storage. The brush protector member 580 helps to keep the bristle members 160 enclosed in a substantially airtight manner which keeps the bristle members from drying out and improves the longevity of the bristle members for months until needed. The present paint brush storage protector member 580 is preferably made of a plastic or vinyl type material and is form-fitting to the particular paint brush in use. As a result, a plurality of different size protector bags 582 will be made so as to be compatible with the different size paint brushes 20 associated with the present systems. A form-fitting protector member 580 reduces air to a minimum inside bag member 582 and the closure member 584 can be an adjustable closure member so as to seal off the bristle members 160 and minimize air flow into the bag 582. This helps to preserve moisture inside the bag 582 which in turn keeps the bristle members moist and extends their longevity. A cap member (not shown) can be engaged with the handle end portion 150 of paint brush apparatus 20 once quick connect/disconnect coupling member 165 is removed from connector member 167. This cap member would be engageable with coupling member 167 (FIG. 15A) and would further help to keep air from entering the bristle members 160 through the tubing 170 and bladder members 205, 215 and 225. A cap member (not shown) can also be engaged with tubing 85 or connector portion 166 when coupling member 165 is removed from connector member 167. In fact, a cap member (not shown) can be positioned at any tube termination point.

Figure 34:
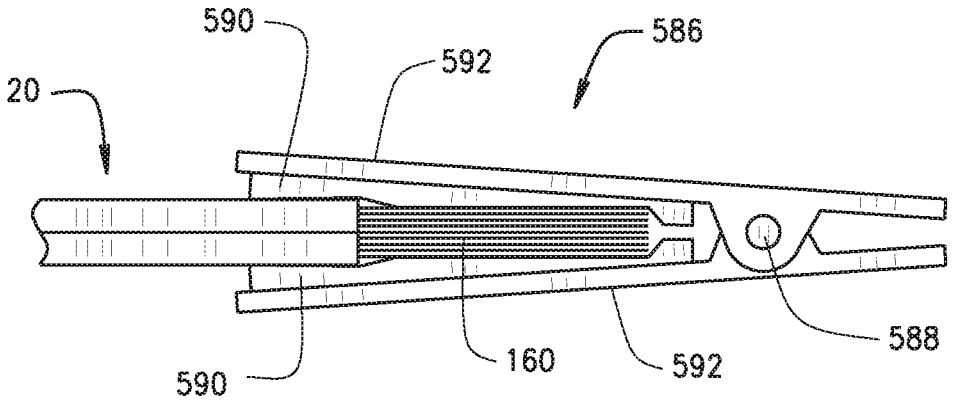
FIG. 34 is a side elevational view of another embodiment of a paint brush protector member positioned in operative use surrounding the bristle members of a paint brush apparatus.

FIG. 34 illustrates still another embodiment 586 of a brush protector member which is particularly useful during a painting operation when a painter is moving from one location to another, or during brief stoppage intervals such as changing paint container members. Paint brush protector member 586 includes a clamping member having a pair of arm members 592 which are pivotally biased around pivot pin 588 to their closed or clamped position around paint brush apparatus 20 and its associated bristle members 160 as illustrated in FIG. 34. The arm members 592 are movable between an open position for receiving the bristle members 160 of paint brush apparatus 20 and a closed position surrounding the bristle members 160. Clamping member 586 includes a pair of moisture absorbent pads 590 which come into direct contact with bristle members 160 when the clamp protector mechanism 586 is in its closed position thereby keeping the bristle members moist and clear of debris while moving from one location to another, or while in temporary non-use. Clamping member 586 also prevents spreading paint with an exposed brush inadvertently or accidentally while moving from one location to another.

Pads 590 are associated with the arm members 592 as illustrated in FIG. 34. The moisture absorbent pads 590 keeps the bristle members 160 and any paint or stain or other fluid/substance associated therewith moist while the brush is in temporary non-use. This keeps the bristle members and any paint associated therewith from drying out during this temporary stoppage. Clamp member 586 can be easily operated and moved between its open and closed positions by applying force to the terminal end portions of the arm members 592 as illustrated in FIG. 34. Once paint brush apparatus 20 is removed from clamping protector member 586, the moisture absorbent pads 590 are easily cleanable and rinsable using water after use. Any known moisture absorbent pad can be used including a sponge-like material which can be kept moist when the clamping member 586 is in operative use around a particular paint brush apparatus 20. Protector member 586 can be easily attached to carrier member 10 through the use of a pocket or holster (not shown) attached thereto or protector member 586 can be housed in a pants pocket or attached to a pocket, belt or ladder, with or without a brush clamped therewithin.

The present paint brush protector members 580 and 586 can be easily used both during the painting process as well as for storage of a particular paint brush so as to keep the bristle members moist and clean and prolong the longevity of the paint brush. In addition, the quick connect/disconnect members 69 and 165 associated with both the present paint container member 50, the pump member 70 and the paint brush apparatus 20 allows a user to quickly connect and disconnect the paint brush apparatus 20 as well as the paint container member 50 for all of the reasons explained above. Both the bags and paint brushes are easily and quickly changed out for fast paint color changes, different types or sizes of brushes, and for storage. As a result, the various paint transfer systems disclosed herein provide an improved paint transfer system, all of which are compact, easy to use, and more efficient at distributing paint, stain or any other spreadable fluid/substance via a paint brush to a paint surface.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

Thus, there has been shown and described several embodiments of a novel paint transfer system. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". In addition, use of the terms "coupled to" or "coupled with" in the foregoing specification and subsequent claims is intended to mean that other members, components and/or mechanisms may lie between the two members that are "coupled together", and direct attachments, connection or mating of the two members is not required. The same definition is likewise true when using the term "in fluid connection with" in the foregoing specification and subsequent claims. Two members, components or mechanisms "in fluid communication with" each other does require direct connection, attachment or mating between such members but does mean that other members, components and/or mechanisms may lie between such members.

Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A paint transfer system for providing paint to a paint brush comprising:

a paint container member for holding and storing paint;

a manually activated pressure pump coupled with said paint container member for providing pressure within said paint container member;

a paint brush apparatus including a handle portion having a terminal end, a base portion at an end of said handle portion opposite said terminal end, and a plurality of bristle members extending from said base portion, said paint brush apparatus being coupled to said paint container member; and a manually activated remote control member positioned at an intermediate location between said paint container member and said terminal end of the handle portion of said paint brush apparatus for selectively controlling the flow of paint to said paint brush apparatus, wherein the manually activated remote control member is further positioned at a distance away from the terminal end of the handle portion of said paint brush apparatus, the manually activated remote control member further comprising a central passage extending entirely through a length of the manually activated remote control member;

flexible tubing fluidly connecting the paint container member and the paint brush apparatus, said flexible tubing passing into, through, and out of the central passage in the manually activated remote control member forming a sliding engagement between the manually activated remote control member and the flexible tubing wherein manually activated remote control is selectively positionable at different points along the flexible tubing;

wherein when said pressure pump is manually activated to increase pressure in said paint container member, paint is forced to said remote control member, and when said remote control member is selectively activated, paint is provided to said paint brush apparatus.

2. The paint transfer system of claim 1 wherein the manually activated remote control member includes an activation member coupled to a lip member, the activation member is movable between a first relaxed position wherein said lip member engages the flexible tubing and prevents paint from flowing past said remote control member, and a second activated position wherein said lip member no longer engages said flexible tubing and allows paint to flow through said flexible tubing past said remote control member to said paint brush apparatus, said lip member being biased towards its first relaxed position.

3. The paint transfer system of claim 1 wherein the paint brush apparatus includes a bladder member coupled to said paint container member via the flexible tubing.

4. The paint transfer system of claim 1, wherein said manually activated pressure pump further comprises:

a pneumatic piston coupled to said paint container member for providing pneumatic pressure to said paint container member;

a handle mechanism coupled with said pneumatic piston for reciprocating said pneumatic piston; and wherein when said handle mechanism is configured to reciprocate said pneumatic piston, said pneumatic piston is configured to supply pneumatic pressure to said paint container member thereby expelling paint from said paint container member.

5. The paint transfer system of claim 1, further comprising a clamp on the manually activated remote control member, the clamp selectively engageable with the flexible tubing to limit further movement of the manually activated remote control member along the flexible tubing.

6. The paint transfer system of claim 1, further comprising a light integrated with the manually activated remote control member.

* * * * *